US007950454B2

(12) United States Patent
Patel et al.

(10) Patent No.: US 7,950,454 B2
(45) Date of Patent: May 31, 2011

(54) TECHNIQUE AND SYSTEM FOR COMPLETING A WELL

(75) Inventors: Dinesh R. Patel, Sugar Land, TX (US); Axel Destremau, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 229 days.

(21) Appl. No.: 12/169,715

(22) Filed: Jul. 9, 2008

(65) Prior Publication Data

US 2009/0025923 A1 Jan. 29, 2009

Related U.S. Application Data

(60) Provisional application No. 60/951,302, filed on Jul. 23, 2007.

(51) Int. Cl.
*E21B 43/04* (2006.01)
*E21B 43/08* (2006.01)

(52) U.S. Cl. ..... 166/278; 166/51

(58) Field of Classification Search ..... 166/278, 166/51
See application file for complete search history.

(56) References Cited

U.S. PATENT DOCUMENTS 5,865,251 A * 2/1999 Rebardi et al. ..... 166/278
6,140,277 A 10/2000 Tibbles
6,216,785 B1 4/2001 Achee
6,220,345 B1 4/2001 Jones
6,298,916 B1 * 10/2001 Tibbles et al. ..... 166/278
6,520,254 B2 2/2003 Hurst
6,571,875 B2 * 6/2003 Bissonnette et al. ..... 166/278
6,575,245 B2 6/2003 Hurst
6,857,475 B2 2/2005 Johnson
7,104,324 B2 9/2006 Wetzel
7,182,134 B2 2/2007 Wetzel
7,222,676 B2 5/2007 Patel
7,461,695 B2 12/2008 Boney
2002/0074119 A1 6/2002 Bixenman
2002/0096328 A1 7/2002 Echols
2002/0125009 A1 9/2002 Wetzel
2003/0079878 A1 5/2003 Pramann
2003/0221829 A1 * 12/2003 Patel et al. ..... 166/278
2004/0163811 A1 8/2004 McKee
2007/0114043 A1 5/2007 Richards
2007/0235185 A1 * 10/2007 Patel et al. ..... 166/250.01

* cited by examiner

*Primary Examiner* — Giovanna C Wright
(74) *Attorney, Agent, or Firm* — David Matthews; Rodney Warfford

(57) ABSTRACT

A technique that is usable with a well includes running a screen assembly and a service tool as a unit into a well and using the service tool in connection with a sand control operation. The use of the service tool in connection with the sand control operation includes operating at least one valve of the screen assembly. The technique includes withdrawing the service tool from the well after the sand control operation and running a completion into the well to operate the valve(s) of the screen after the withdrawal.

10 Claims, 21 Drawing Sheets

TECHNIQUE AND SYSTEM FOR COMPLETING A WELL

This application claims the benefit under 35 U.S.C. §119 (*e*) to U.S. Provisional Patent Application Ser. No. 60/951,302, entitled, "INTEGRATED FLOW CONTROL VALVE AND SCREEN COMPLETION SYSTEM FOR GRAVEL PACK," which was filed on Jul. 23, 2007, and is hereby incorporated by reference in its entirety.

BACKGROUND

Hydrocarbon fluids, such as oil and natural gas, are obtained from a hydrocarbon-bearing formation, referred to as a reservoir, by drilling a well that penetrates the formation. After a wellbore is drilled, the well is completed before hydrocarbons are produced from the well. Completing the well involves designing, selecting, and installing equipment and materials in or around the wellbore for conveying, pumping, or controlling the production or injection of fluids.

The sand control completion of a typical well may involve the downhole construction of a two-stage filter for purposes of preventing unconsolidated materials from being produced with the oil or gas. The filter typically includes gravel pack sand (the outer stage) and a screen or liner (the inner stage). The gravel pack sand is sized according to the particle size distribution of the unconsolidated materials, and the screen or liner has openings that are sized to retain the gravel pack sand. The gravel pack sand retains the unconsolidated formation materials, and the screen liner retains the gravel pack sand. The produced oil or gas flows through the gravel pack sand, through the screen or liner and then typically into a production tubing string that communicates the fluid to the surface of the well. The gravel pack sand typically is deposited around the screen or liner in a "sand control" operation.

A potential challenge associated with a conventional sand control application is that the gravel sand packed region may trap formation damage in the reservoir. Therefore, for purposes of bypassing any damage, which may be trapped by the gravel sand pack, a hydraulic fracturing operation may be performed to fracture the unconsolidated formations. The phrase "frac pack" typically is used to describe simultaneously or near simultaneously hydraulically fracturing an unconsolidated formation and introducing the gravel pack sand around the screen or liner.

The screen or liner typically is run downhole and installed as a lower completion, and then the sand control/frac pack operation is performed. After the completion of the sand control/frac pack operation, a flow control valve typically is run downhole as part of an upper completion. This approach typically places a limit of two flow control valves that may be installed: a first flow control valve that controls flow through the inner passageway of a tubing that is in fluid communication with one of the zones; and a second flow control valve that controls a flow in an annular space outside of the tubing, which is in fluid communication with another one of the zones.

SUMMARY

In an embodiment of the invention, a technique that is usable with a well includes running a screen assembly and a service tool as a unit into a well and using the service tool in connection with a sand control operation. The use of the service tool in connection with the sand control operation includes operating at least one valve of the screen assembly. The technique includes withdrawing the service tool from the well after the sand control operation and running a completion into the well to operate the valve(s) of the screen assembly.

In another embodiment of the invention, an apparatus that is usable with a well includes a service tool and a screen assembly that is adapted to run downhole as a unit with the service tool. The screen assembly includes at least one valve, which is adapted to be controlled by the service tool in connection with a sand control operation and be controlled by a well completion that is run downhole and replaces the service tool after the sand control operation.

In yet another embodiment of the invention, a screen assembly that is usable with a well includes a screen, at least one valve and a mechanism. The mechanism is to be controlled by a service tool in connection with a sand control operation to selectively open and close the valve(s), and the mechanism is to be controlled by a completion that replaces the service tool to selectively open and close the valve(s).

Advantages and other features of the invention will become apparent from the following drawing, description and claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments are possible.

As used here, the terms "above" and "below"; "up" and "down"; "upper" and "lower"; "upwardly" and "downwardly"; and other like terms indicating relative positions above or below a given point or element are used in this description to more clearly describe some embodiments of the invention. However, when applied to equipment and methods for use in wells that are deviated or horizontal, such terms may refer to a left to right, right to left, or diagonal relationship as appropriate.

Figure 1:
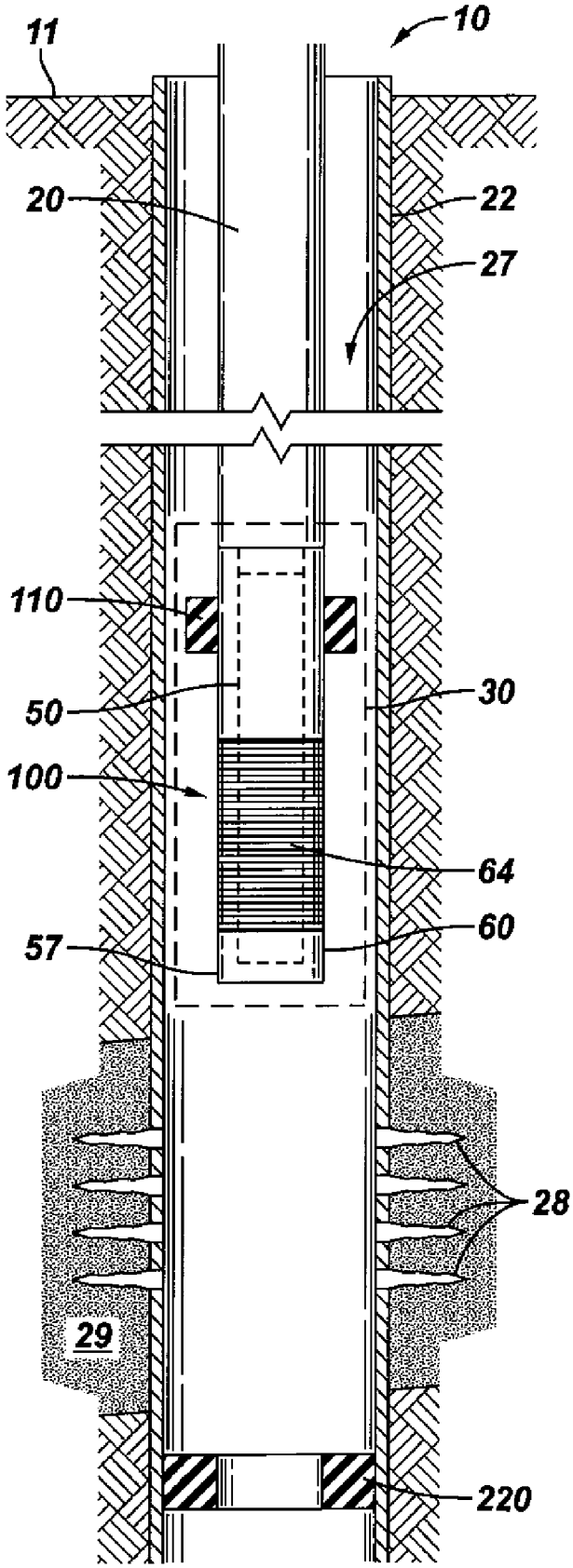
FIG. 1 depicts a lower completion assembly being run downhole into a well on a tubing string according to an embodiment of the invention.

FIG. 1 depicts a lower completion assembly 30 that is run downhole into an exemplary wellbore 27 for purposes of completing an exemplary zone 29 of a well 10. The completion assembly 30 includes a screen assembly 100 that ultimately forms at least part of a lower completion for the zone 29.

In addition to the screen assembly 100, the completion assembly 30 includes a service tool 50 that is run downhole as a unit with the screen assembly 100. As depicted in FIG. 1, in accordance with embodiments of the invention, the completion assembly 30 may form the lower part of a tubular string 20 that extends to the Earth surface 11 of the well 10. The wellbore 27 may be cased (via a depicted casing string 22) or may be uncased, depending on the particular embodiment of the invention. Furthermore, the well 10 may be a subterranean or subsea well, and the wellbore 27 may be a deviated or lateral wellbore, depending on the particular embodiment of the invention.

For the example that is depicted in FIG. 1, the string 20 is run downhole until a bottom end 57 of the completion assembly 30 stabs into a sump packer 220 that has already been set inside the casing string 22. The sump packer 220 is anchored in place to form the lower end of the zone 29. A packer 110 of the completion assembly 30 forms the upper end of the zone 29 after the assembly 30 is run to its final position and the packer 110 is set. It is noted that for the state of the well depicted in FIG. 1, a perforating operation has already been conducted in the zone 29 to perforate the casing string 22 and form perforation tunnels 28 into the surrounding formation.

Although a single screen assembly 100 is depicted in FIG. 1, the lower completion may contain multiple screen assemblies 100. Each screen assembly 100 may be run downhole as a separate lower completion assembly 30; or alternatively, the lower completion assembly may contain multiple screen assemblies 100. Thus, for the example of multiple screen assemblies being installed in multiple downhole trips, the bottom of the lower completion assembly 30 may be stabbed into the top screen assembly 100 of a series of screen assembly 100, with the bottom screen assembly 100 being stabbed into the sump packer 220. For purposes of simplicity, it is assumed, unless otherwise noted, that the screen assembly 100 is the first screen assembly 100 to be installed, and it is assumed that the lower completion assembly 30 contains a single screen assembly 100

As described further below, the screen assembly 100 includes an integrated, or built-in, flow control valve 60 that is operated to control fluid communication through a screen 64 of the screen assembly 100 and thus, control the production of oil or gas for the zone 29. The screen 64 serves as the inner stage of a two stage filler, and as such, supports gravel sand that is packed around the screen 64, as further described below. The flow control valve 60 controls fluid communication between an annular region that surrounds the screen 64 and the central passageway of the string 20 and extends between the upper packer 110 (when set) and the sump packer 220.

The flow control valve 60 is controlled by the service tool 50 during operations associated with installing the screen assembly 100, fracturing and depositing gravel sand around the screen 64. As described below, at the conclusion of these operations, the service tool 50 is removed from the well 10; and one or more screen assemblies 100 may be run downhole as part of the lower completion and gravel packed. After the installation of the screen assembly(ies) 100, an upper completion is run into and installed in the wellbore 27; and the flow control valve 60 are then controlled by the upper completion.

As described further below, the flow control valve 60 is used in the completion operations to install and gravel pack the screen assembly 100, used in a well control application after the withdrawal of the service tool 50 from the well 10, and ultimately used to control the production of oil or gas from the associated zone. The screen assembly 100 may contain additional ports/valves which, as described herein, may be controlled for purposes of facilitating these operations.

Figure 2:
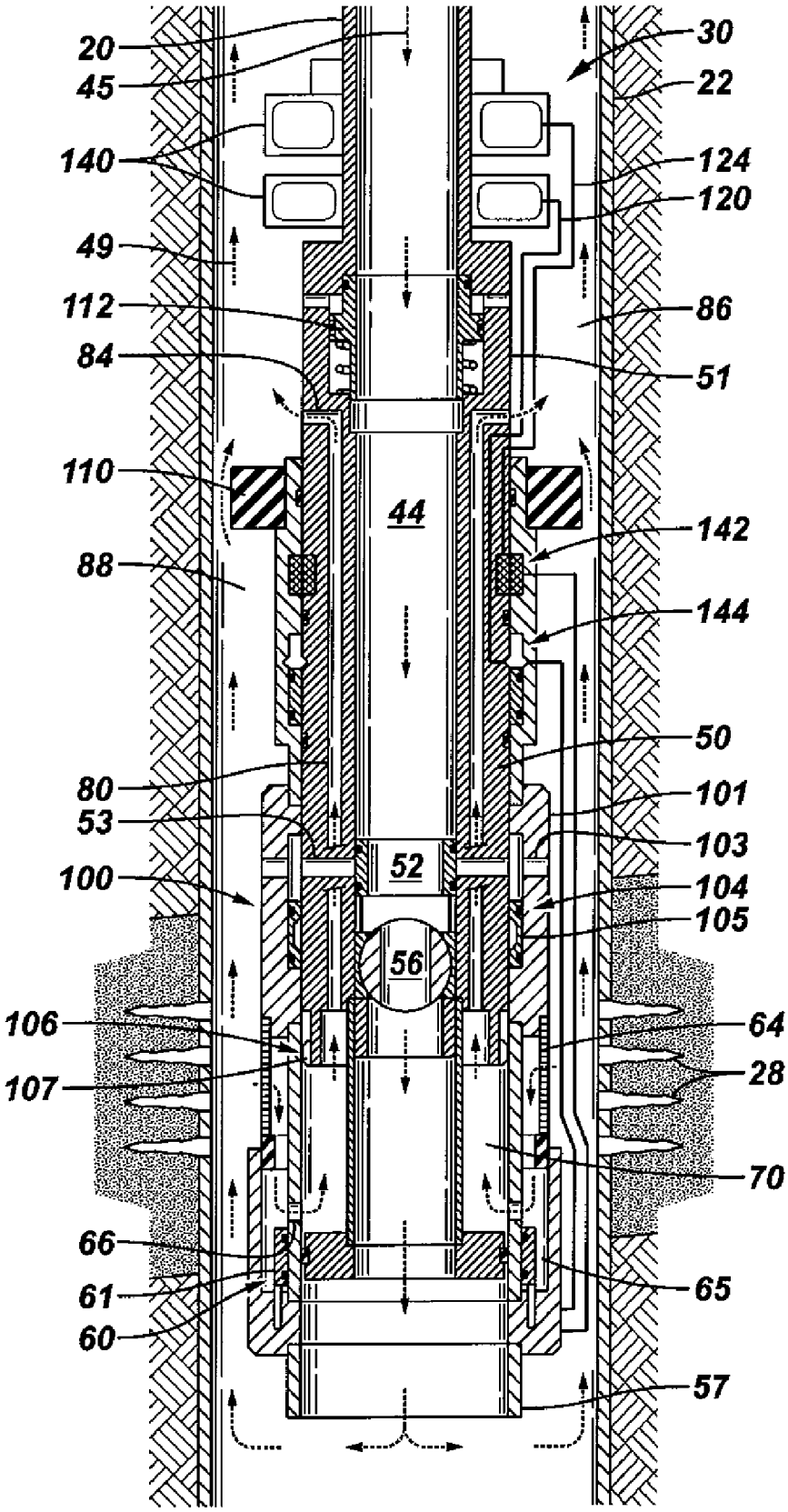
FIG. 2 is a schematic diagram of the completion assembly of FIG. 1 in a run-in-hole state according to an embodiment of the invention.
Figure 9:
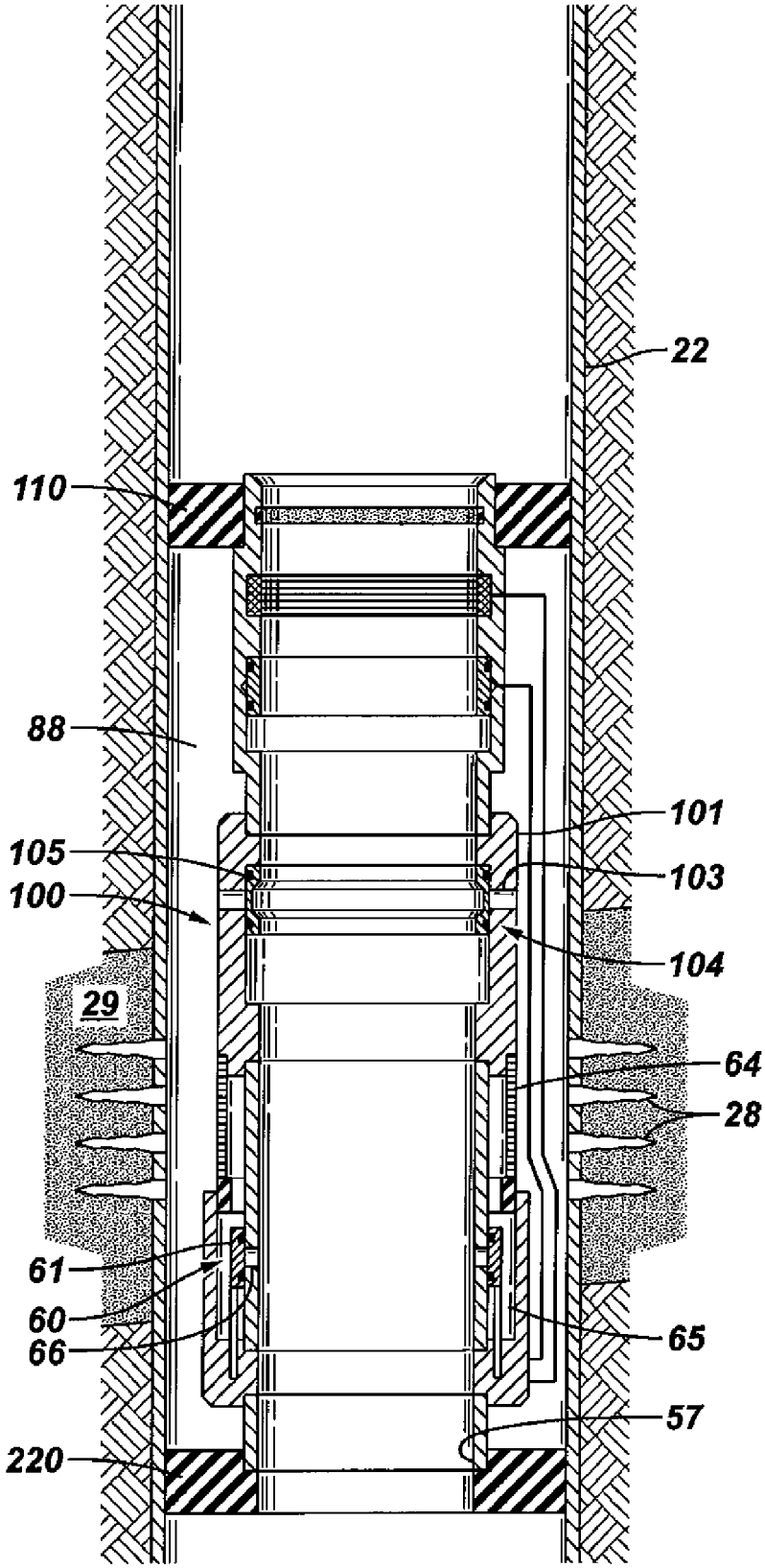
FIG. 9 is a schematic diagram of a screen assembly of the completion assembly of FIG. 1 after withdrawal of a service tool from the completion assembly according to an embodiment of the invention.

FIG. 2 depicts the completion assembly 30 in a run-in-hole state, a state of the assembly 30 before a lower end 57 of the assembly 30 (and screen assembly 100) is stabbed into the sump packer 220 (not depicted in FIG. 2) or lower screen assembly 100. As depicted in FIG. 2, the service tool 50 is run downhole inside the screen assembly 100. The screen assembly 100 in the absence of the service tool 50 is depicted in FIG. 9. Still referring to FIG. 2, as an example, the packer 110 may contain a releasable latch that engages the service tool 50 to retain the tool until the tool 50 is retrieved from the well 10, as further described below.

The service tool 50 includes a tubular housing 51 that contains a central passageway 44, which forms a segment of the central passageway of the tubular string 20 (see FIG. 1). When installed inside the screen assembly 100, hydraulic and inductive-type electrical interfaces of the service tool 50 mate with corresponding hydraulic 144 and electrical 142 wet connection interfaces, respectively, of the screen assembly 100. When these connections are made, electrical and hydraulic modules 140 of the service tool 50 provide downhole power and control to operate one or more valves of the screen assembly 100, such as the flow control valve 60.

In accordance with some embodiments of the invention, the flow control valve 60 is a sleeve valve, which contains a sleeve 61 that is controlled by an associated actuator of the screen assembly 100 (as controlled by one of the modules 140) to open and close communication through radial flow ports 66 that are formed in a housing 101 of the screen assembly 100.

More specifically, the screen 64 receives well fluid from the exterior region that surrounds the screen 64 and communicates this fluid into an annular space 65 of the housing 101. The sleeve 61 controls communication between the annular spaces 65 and the flow ports 66, which, in turn, are in communication with an inner annular space 70 of the service tool 50. Thus, when the sleeve 61 is in a closed position, the annular spaces 65 and 70 are isolated. When the sleeve 61 is moved to an open position, the annular space 65 is communicated through the ports 66, and the flow through the valve 60 is routed longitudinally through crossover ports 80 of the service tool 50 and through radial ports 84 into an annular region 86 above the packer 110.

In addition to the flow control valve 60, the screen assembly 100 may contain additional valves, such as a gravel packing circulation valve 104 that is run downhole open and is closed by the service tool 50 upon withdrawal of the tool 50 from the well 10. As shown in FIG. 2, radial ports 103 of the circulation valve 104 are aligned with radial ports 53 of an inner circulation valve 52 of the service tool 50. A sleeve 105 of the circulation valve 104 may be initially in a position to open communication through the ports 103 and thus, establish communication between the string passageway and the annulus, as depicted in FIG. 2.

The circulation valve 52, in accordance with embodiments of the invention, may contain an actuator module that is controlled by fluid pressure encoded commands (for example) that are communicated downhole through the passageway 44 of the tubing string 20. In accordance with some embodiments of the invention, the screen assembly's circulation valve 104 remains open while the service tool 50 is installed in the screen assembly 100. Thus, as along as the service tool 50 is present, the state (open or closed) of the service tools circulation valve 52 controls communication between the central passageway and the annular region that surrounds the valve 104.

The downhole module that controls the circulation valve 52 may also independently control a ball valve 56 (of the service tool 50) in response to command-encoded stimuli that are communicated from the surface 11 of the well 10. As depicted in FIG. 2, the ball valve 56 controls communication through the central passageway of the service tool 50 and is located below the circulation valve 52. The ball valve 56 is initially open when the completion assembly 30 is run downhole.

Among its other features, in accordance with some embodiments of the invention, the service tool 50 includes a reverse circulation check valve 112 that, as its name implies, is used to establish communication between the central passageway 44 of the assembly 30 (above the ball valve 52) and the annulus of the well above the packer 110 for purposes of reverse circulating gravel slurry out of the tubing string 20, as further described below.

For the run-in-hole state of the lower completion assembly 30 (depicted in FIG. 2), the packer 110 is unset, and the assembly 30 has not been stabbed into the sump packer 220 (or into another screen assembly 100). As shown, a flow 45 may be introduced from the surface of the well 10 through the central passageway 44 and through the ball valve 56, which is open. The flow 45 produces a return flow 49 that returns via the annulus to the surface of the well 10. The flow 45 may be a relatively clean gravel packing fluid that displaces any mud left over from the drilling operation so that the clean fluid may be introduced into the well to lift the mud to the surface 11 as the lower completion assembly is being run downhole. After the mud is displaced, the completion assembly 30 may be run further downhole to stab the completion assembly 30 into the sump packer 220 (or screen assembly 100).

To summarize, for the run-in-hole state of the completion assembly 30, the reversing circulation valve 112 is closed (the initial state of the valve 112), the gravel packing circulation valve 52 is closed (the initial state of the valve 52), the ball valve 56 is open (the initial state of the valve 56), the fluid control valve 60 is open (the initial state of the valve 60), and the packer 110 is unset. This state permits the circulation of gravel packing fluid to displace mud from the well.

Figure 3:
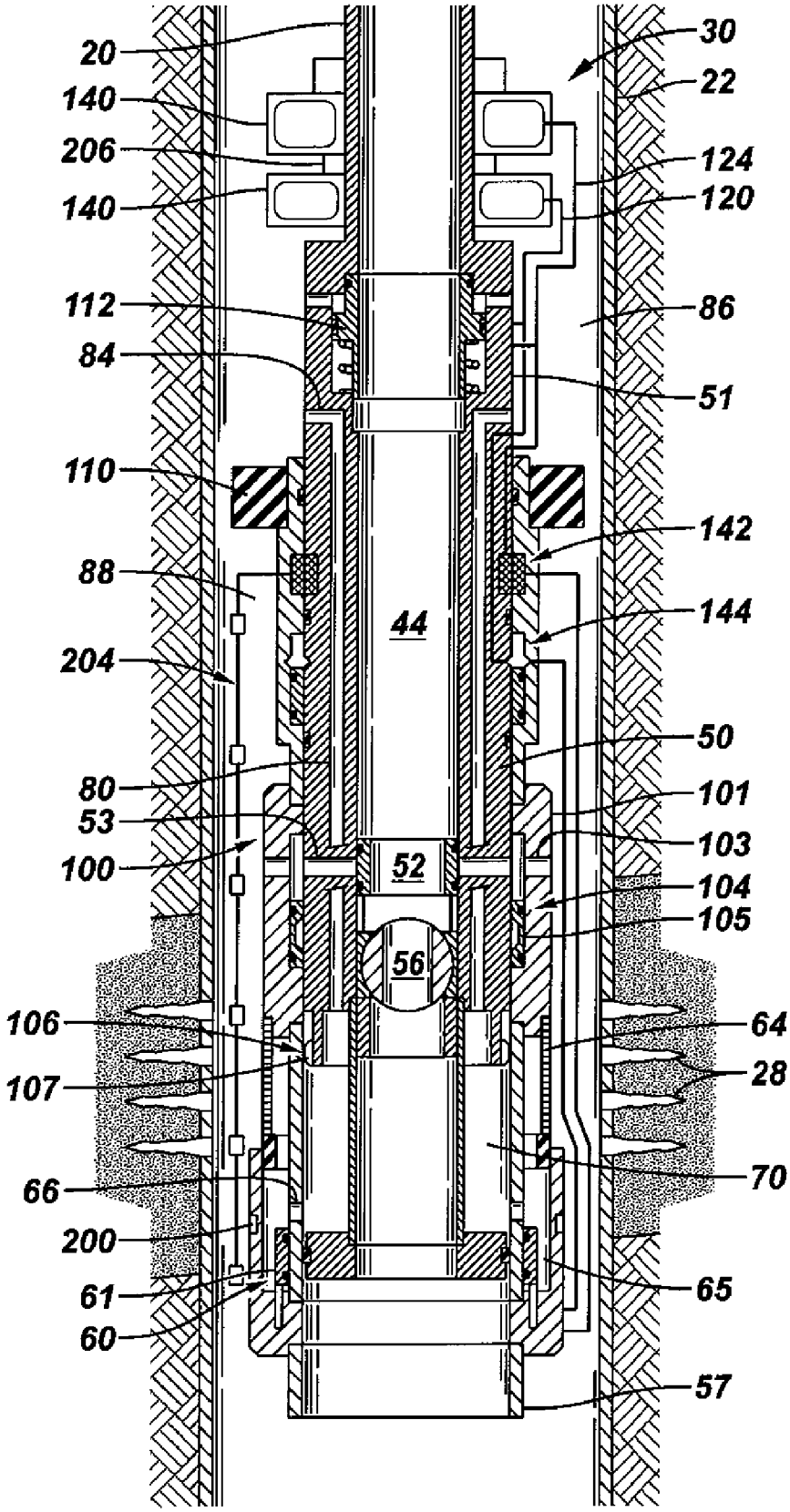
FIG. 3 is a schematic diagram illustrating sensor and telemetry modules of the completion assembly of FIG. 1 according to an embodiment of the invention.

FIG. 3 depicts various sensors and wireless telemetry modules of the completion assembly 30 in accordance with embodiments of the invention. As examples, the completion assembly 30 may include a sensor module 200 that is part of the screen assembly 100 and may include various sensors to sense pressure, temperature, flow, density, etc. Additionally, the module that controls the ball valve 56 may include sensors to sense pressure, flow, etc. The screen assembly 100 may also include a distributed sensor bridal 204, which contains temperature, pressure, and other sensors to measure conditions in the annulus between the packers 110 and 220. The service tool 50 may also include a module 206 to measure conditions above the packer 110, such as pressure, flow, etc.

Figure 4:
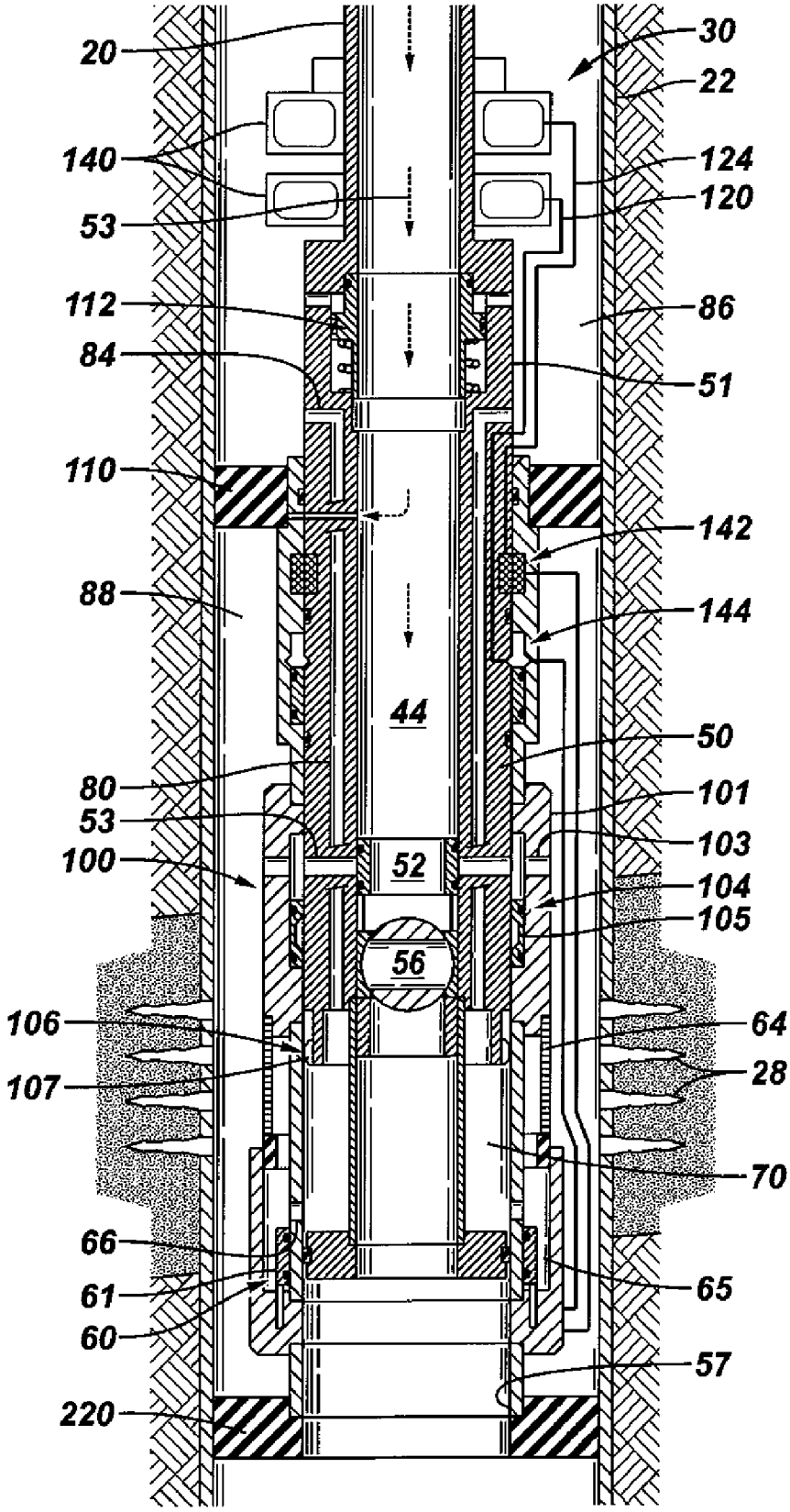
FIG. 4 is a schematic diagram of the completion assembly of FIG. 1 in a state to set and test a sand control packer of the assembly according to an embodiment of the invention.

FIG. 4 depicts the completion assembly 30 in a state for setting and testing the packer 110. For this to occur, a command is communicated from the surface of the well to a control module for the ball valve 56 for purposes of causing the ball valve 56 to close. Fluid (represented by a flow 53) is then communicated into the central passageway 44 for purposes of increasing the tubing pressure to set the packer 110. Thus, the differential pressure between the tubing and the annulus causes a setting piston of the packer 110 to compress one or more sealing elements to form a seal between the interior of the casing string 22 and the exterior of the screen assembly 100, as depicted in FIG. 4. Although for purposes of example, a tubing conveyed (TCP) packer has been described, it is understood that other types of packers (hydraulically set, electrically set, mechanically set, weight set, etc.) may be used in accordance with other embodiments of the invention.

After the packer 110 has been set, fluid may be communicated into an annular 86 region above the packer 110 for purposes of pressure testing the packer 110. Subsequently, operations may then proceed to deposit the gravel sand into an isolated annular region 88 that exists between the packers 110 and 220.

Figure 5:
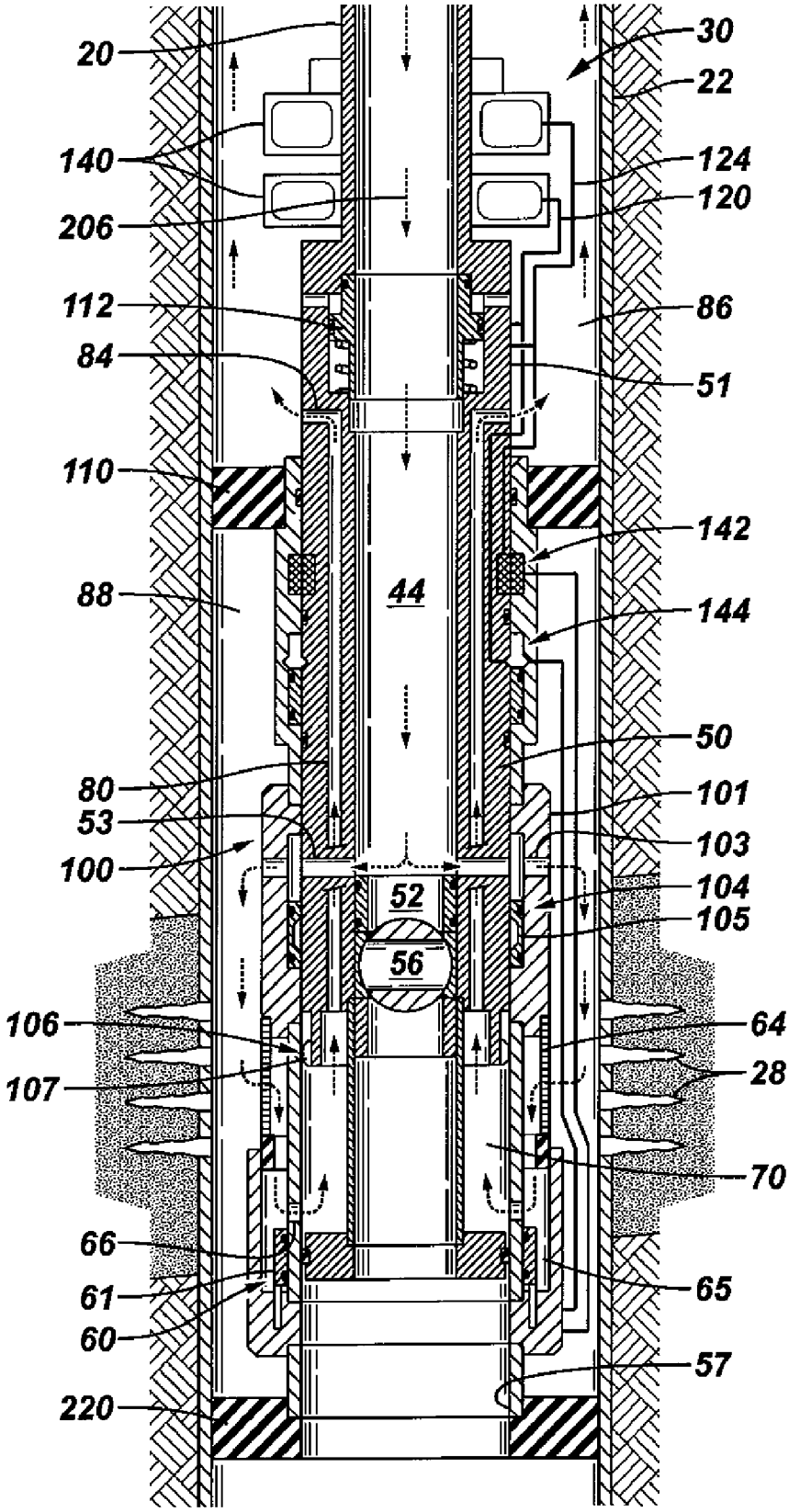
FIG. 5 is a schematic diagram of the completion assembly of FIG. 1 in a state to circulate a gravel slurry in connection with a sand control operation according to an embodiment of the invention.

More specifically, referring to FIG. 5, for purposes of depositing gravel sand between the packers 110 and 220, the ball valve 56 remains closed, and a command is communicated from the surface of the well through the tubing string 20 for purposes of opening the circulation valve 52 to establish communication between the central passageway 44 and the annular region 88. Upon this occurrence, a gravel slurry flow 206 is introduced through the tubing string 20 into the central passageway 44. As depicted in FIG. 5, the slurry flow exits the ports 103 of the circulation valve 104 of the screen assembly 100 and enters the annular region 88. Gravel sand from the slurry flow is deposited inside the region 88 outside of the screen 64, and the fluid from the slurry flow is communicated through the screen 64 and into crossover ports 80 of the service tool 50, where the fluid flow returns to the annular region 86 above the gravel packing packer 110. The slurry flow continues until a sufficient amount of gravel sand is deposited in the annular region 88.

It is noted that in accordance with some embodiments of the invention, the sand control operation may proceed simultaneously with a fracturing operation. In this regard, in a technique often referred to as "frac pack," the gravel packing fluid is pressurized to promote fracturing of the surrounding unconsolidated formation materials concurrently with the sand control operation. In accordance with other embodiments of the invention, the sand control and fracturing operations may occur separately, and in accordance with other embodiments of the invention, the fracturing operation may not be performed. Thus, many variations are contemplated and are within the scope of the appended claims.

Figure 6:
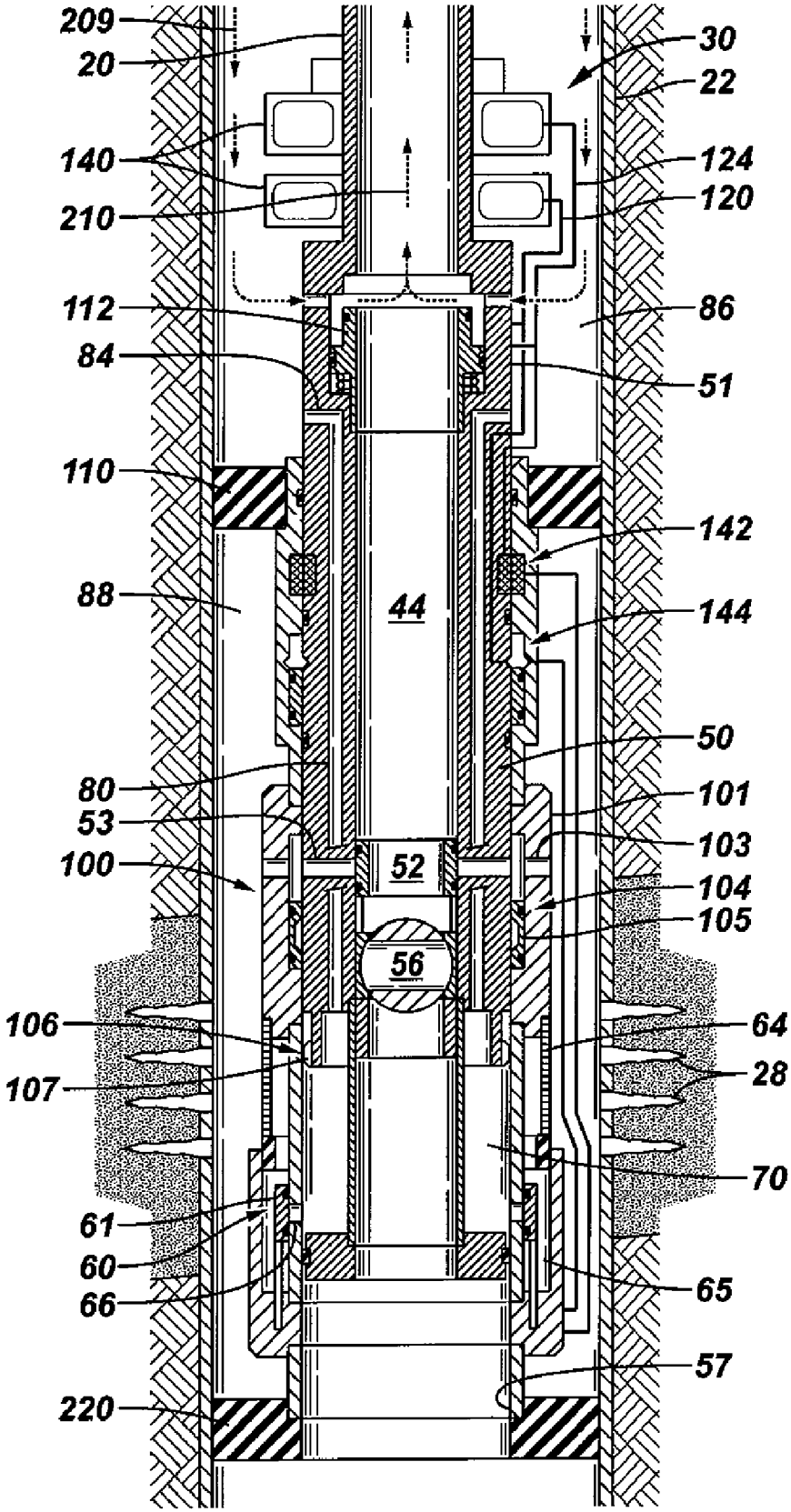
FIG. 6 is a schematic diagram of the completion assembly of FIG. 1 in a state in to circulate gravel slurry out of the tubing string according to an embodiment of the invention.

Referring to FIG. 6, at the conclusion of the sand control/frac pack operation, gravel packing slurry remains inside the tubing string 20. Therefore, the lower completion assembly 30 is placed in a state for reverse circulating the gravel slurry out of the string 20. For this occur, a command may be communicated from the surface of the well to close the circulation valve 52. Another command is communicated from the surface of the well to the modules 140 to close the flow control valve 60. The annular region 86 above the packer 110 is then pressurized to cause the reverse circulation check valve 112 to open to establish communication between the annular region 86 above the packer 110 and the central passageway 44. Because the ball valve 56 is closed (due to the previous operation, which involves the communication of the gravel packing slurry), a pressurized downgoing annulus flow 209 produces an upgoing flow 210 through the tubing string 20 to lift the gravel packing slurry inside the string 20 to the surface of the well 10.

Figure 7:
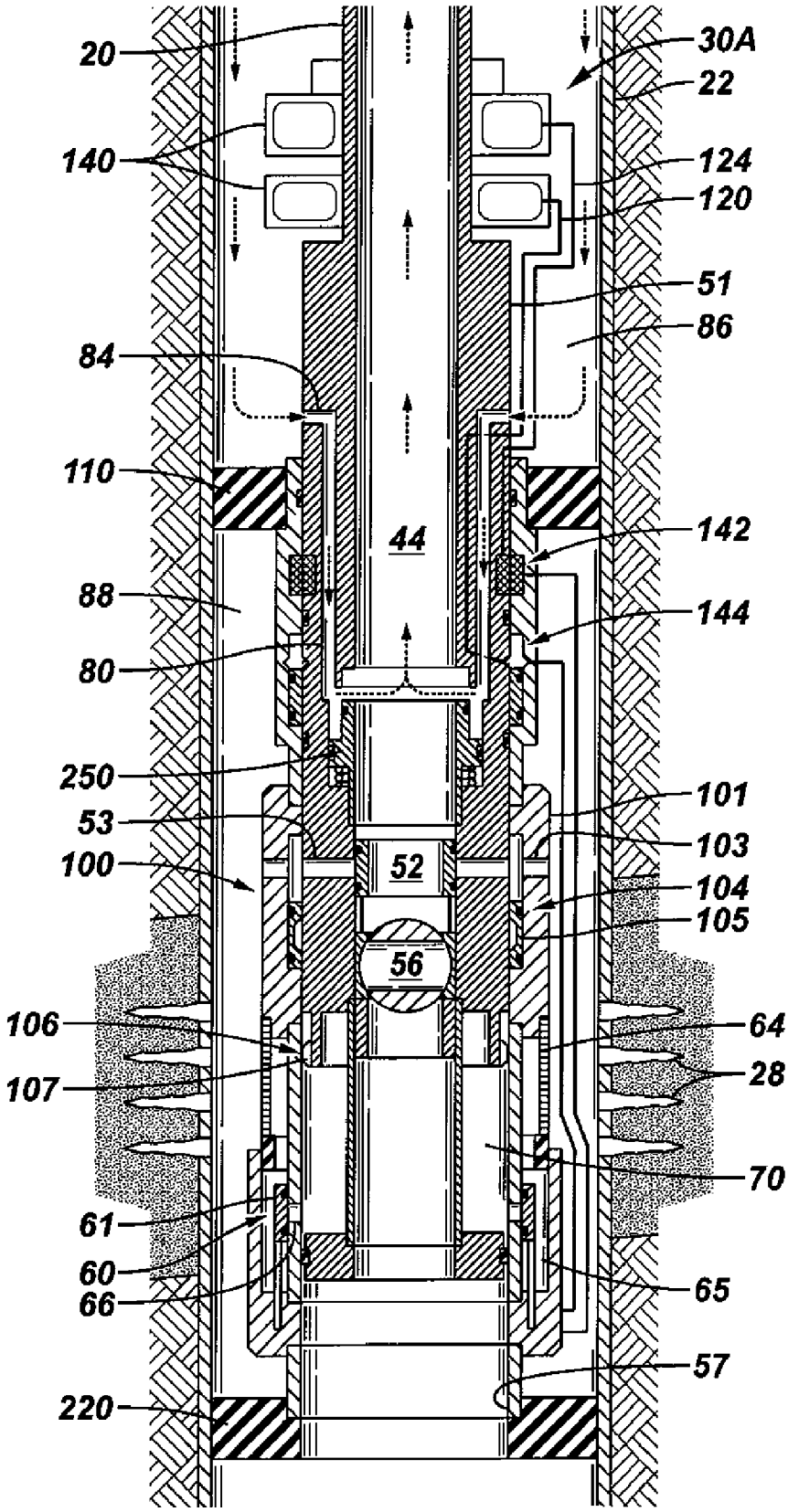
FIGS. 7 and 8 illustrate alternative embodiments of the completion assembly in a state to circulate gravel slurry out of the tubing string.

It is noted that the reversing valve may have alternate constructions and/or locations, depending on the particular embodiment of the invention. For example, FIG. 7 depicts an alternate lower completion assembly 30A that has a similar design to the lower completion assembly 30 with like reference numerals being used to designate similar components. However, unlike the completion assembly 30, the completion assembly 30A has a reversing check valve 250 (in replacement of the valve 112) that is located below the packer 110, is above the ball valve 56 and is in communication with the crossover ports 80. For this configuration, communication occurs between the annular region 86 above the packer 110, through the crossover ports 80 and into the central passageway 44 via the reversing check valve 250.

Figure 8:
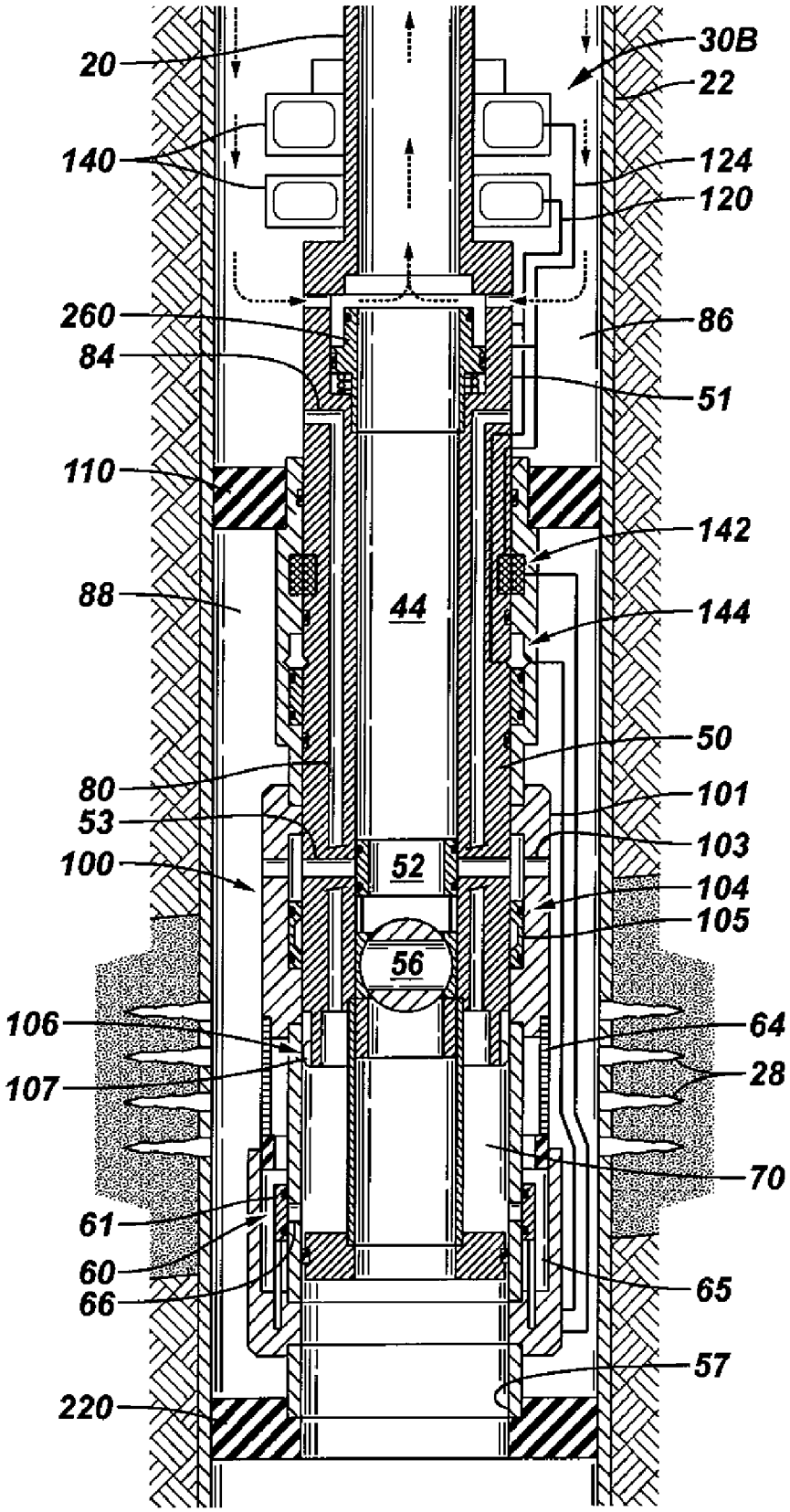

As yet another variation, FIG. 8 depicts an alternate completion assembly 30B that has a similar design to the lower completion assembly 30 with like reference numerals being used to designate similar components. However, unlike the completion assembly 30B, a reversing valve 260 (in replacement of the valve 112) that is in the same position as the reversing valve 112 but is a sleeve valve that is operated by one of the modules 140. Thus, for this embodiment of the invention, a wireless command may be communicated downhole from the surface of the well for purposes of instructing one of the modules 140 to open communication through the valve 260. Thus, many different variations are contemplated and are within the scope of the appended claims.

At the conclusion of the reversing operation, the service tool 50 is unlatched from the screen assembly 100 and withdrawn from the well 10 to leave the screen assembly 100 downhole, as depicted in FIG. 9. As a more specific example, in accordance with embodiments of the invention, the string 20 is pressurized to unlatch the service tool 50 from a latch in the packer 110. A command may then be communicated downhole to the controller for the ball valve 56 to cause the ball valve 56 to open, and subsequently, the service tool 50 may be retrieved from the well 10. Referring to FIG. 9 in conjunction with FIG. 6, as the service tool 50 is being withdrawn from the well 10, a shifting tool 106 (a tool that includes a collet 107, for example) engages the sleeve 105 to shift the sleeve 105 upwardly and close the circulation valve 104. The hydraulic wet connection interface 144 may also contain an isolation sleeve that isolates the hydraulic wet connection interface 144 to prevent wellbore fluid from entering the hydraulic control line of the screen assembly 100 after the service tool's withdrawal.

After withdrawal of the service tool 50, the flow control valve 60 for the screen assembly 100 provides fluid loss and well control, as the flow control valve 60 is closed at this point due to the prior reverse circulation operation. As described further below, an upper completion may then be installed and used to operate the flow control valve 60 for purposes of controlling oil or gas production from the associated zone. The above-described sequence may be repeated for purposes of installing gravel packed screen assemblies 100 in additional zones of the well 10 above the zone 29. In this regard, screen assemblies 100 may be stacked so that the lower end 57 of each screen assembly 100 stabs into the interior of a lower screen assembly 100 to form electric and hydraulic communication channels as well as form seals between each pair of adjacent screen assemblies to communicate the produced oil or gas to the surface 11 of the well 10.

Figure 10:
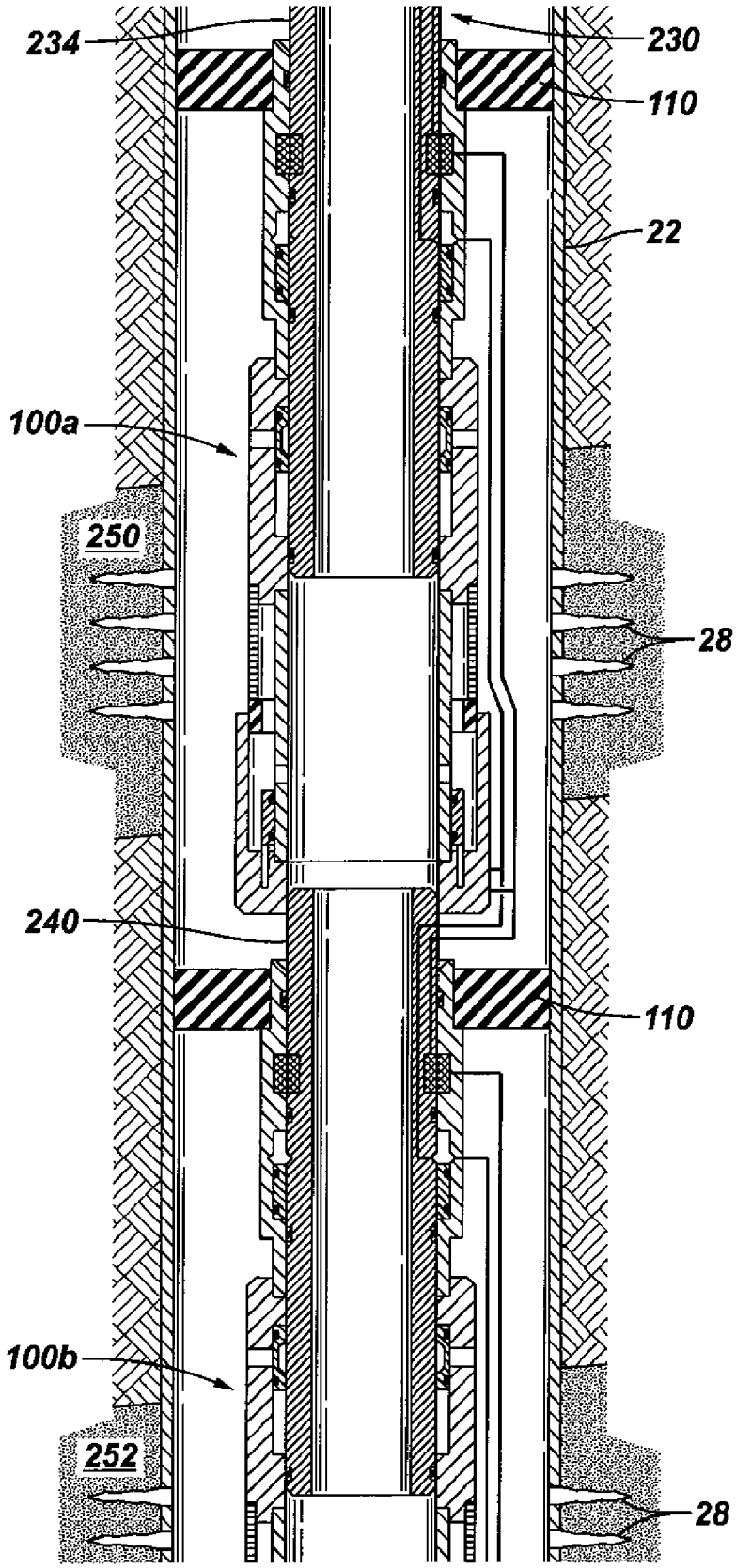
FIG. 10 is a schematic diagram of a multiple zone completion according to an embodiment of the invention.

FIG. 10 depicts an exemplary lower completion that extends into a lower zone 252 and an upper zone 250. More specifically, a screen assembly 100*b*, which has a similar design to the screen assembly 100, is located in the lower zone 252 and is possibly connected to another screen assembly located below the assembly 100*b*. A screen assembly 100*a*, which also has a similar design to the screen assembly 100, is disposed in the upper zone 250 and includes an extension 240 that stabs into the interior of the screen assembly 100*b* for purposes of forming electrical and hydraulic control connections between the screen assemblies 100*a* and 100*b*.

For the example depicted in FIG. 10, an upper completion 230 is run downhole and includes an extension 234 that stabs into the upper screen assembly 100*a*, which is the uppermost screen assembly for this example. The extension 230 is connected to a production string tubing that extends to the surface of the well, and is associated with electric and hydraulic lines that extend to the surface. These electric and hydraulic lines are connected via the hydraulic and electric wet connections of the screen assembly 200 through corresponding wet connections of the extension 234. Thus, with the upper completion 230 in place, the valves of the screen assemblies 100 may be remotely controlled from the surface of the well 10. It is noted that the particular type of wired/wireless communication that is used to control the valves may vary, depending on the particular embodiment of the invention.

In accordance with some embodiments of the invention, the tubular string that is connected to the upper completion 230 may have a wired drill pipe (WDP)-type communication infrastructure in which wiring is built-in into the wall of the pipe. Thus, for this example, wired communication through the wires of the production tubing string may be used for purposes of controlling the various valves of the screen assemblies, such as the flow control valves 60. In other embodiments of the invention, hydraulic and electrical lines may extend to the surface of the well outside of the production tubing string. As yet another example, in accordance with other embodiments of the invention, the upper completion 230 may contain a downhole receiver that includes sensors to sense electromagnetic, fluid pressure, etc., for purposes of detecting and decoding wireless commands that are communicated downhole through the wall of the tubing string, through fluid pressure inside the tubing string, through the annulus of the well, etc. Thus, many different types of wireless and wired communication may be used for purposes of controlling the valves of the screen assemblies, in accordance with the many different embodiments of the invention.

Figure 11:
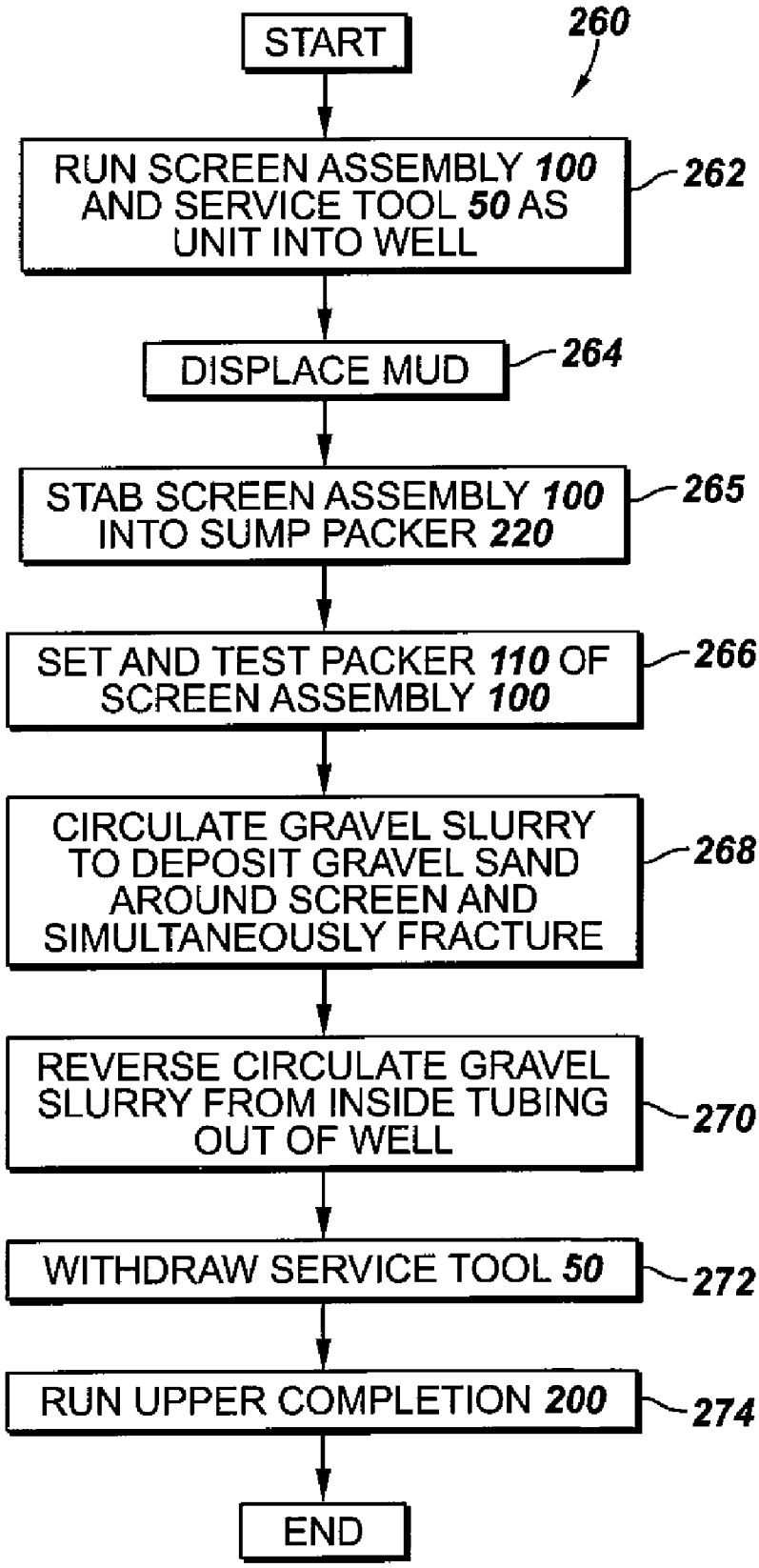
FIG. 11 is a flow diagram depicting a technique to complete a well according to an embodiment of the invention.

Referring to FIG. 11, to summarize, a technique 260 may be used in the well for purposes of performing a sand control and fracturing operation. Pursuant to the technique 260, a screen assembly 100 and service tool 50 are run into a well as a unit, pursuant to block 262. Mud in the wellbore is displaced 264 by circulating fluid through the screen assembly 100, and subsequently, the screen assembly 100 is stabbed into a sump packer 220 or other existing lower completion, pursuant to block 265. A packer 110 of the lower completion is then set and tested, pursuant to block 266. The screen assembly 100 is then configured to circulate a gravel slurry to deposit gravel sand around the screen 64 and perform simultaneous fracturing, pursuant to block 268. Next, the gravel slurry present in the tubing is reverse circulated via the central passageway of the tubing string of the surface of the well, pursuant to block 270; and subsequently, the service tool 50 is withdrawn from the well, pursuant to block 272. An upper completion 200 is then run into the well 270 and engaged with the screen assembly 100, pursuant to block 274.

Other variations are contemplated and are within the scope of the appended claims. For example, completion assemblies that are similar to the ones described above may be used to complete a multiple zone, openhole well. More specifically, referring to FIG. 12, in accordance with embodiments of the invention, a completion assembly 299 includes a screen assembly 100 that is run downhole as a unit with a gravel packing service tool 350. In general, the service tool 350 has a similar design to the service tool 50, with the differences being pointed out below. It is noted that the completion assembly 299 includes screen assemblies 100 that are serially connected together.

Figure 12:
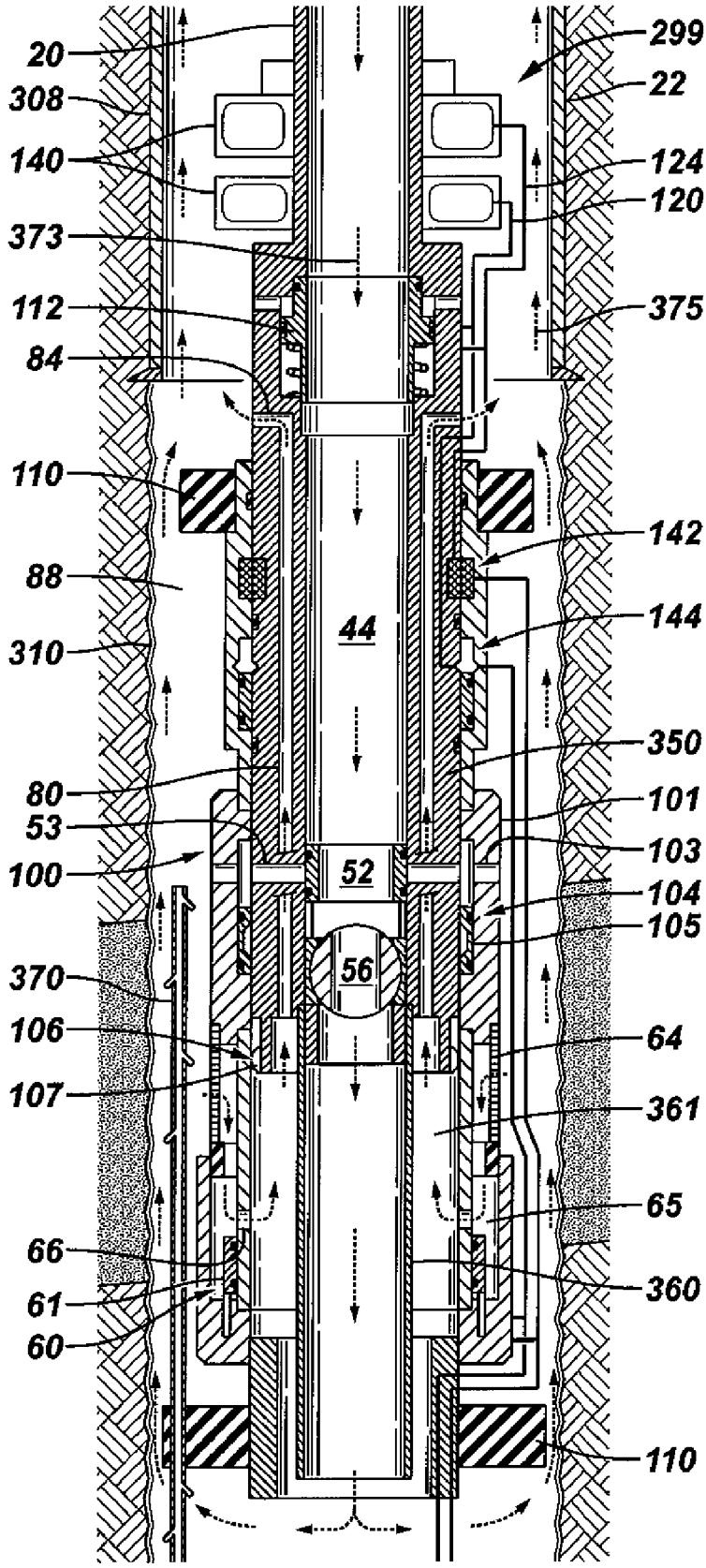
FIG. 12 is a schematic diagram of an open hole lower completion assembly in a run-in-hole state according to an embodiment of the invention.

As shown in FIG. 12, the lower completion assembly 299 may be run downhole into an uncased portion 310 of a wellbore (the upper portion of the which may be eased by a casing 308), and therefore, the lower screen assemblies (not depicted in FIG. 12) also extend further downhole into the uncased wellbore 310. The completion assembly 299 has a similar design to the completion assembly 30, and like reference numerals are used to denote similar components. Unlike the completion assembly 30, the completion assembly 299 has a service tool 350 (that replace the service tool 50), which includes a wash pipe 360 that is in communication with the central passageway of the service tool 350 below the ball valve 56 and establishes an annular space 361 to receive an incoming fluid through the flow control valve 60 of the screen assembly 100 in which the service tool 350 is disposed, as well as the fluids that are received by the flow control valves 60 of the lower screen assemblies. Thus, as depicted in FIG. 12, the wash pipe 360 extends through the central passageway of the lower screen assemblies 100.

Unlike the arrangement described above, each of the screen assemblies 100 below the uppermost screen assembly 100 is run downhole with a shunt tube 370, which contains shunt nozzles and extends through the packer 110. The shunt tube 350 provides a path through the packer 110 for purposes of communicating the gravel packing slurry to simultaneously gravel packing multiple zones.

The completion assembly 299 is in a run-in-hole state in FIG. 12 in that the ball valve 56 and flow control valves 60 are open; and also for this state, the circulation valves 52 and 104 are closed. Also for this state, the packers 110 are unset. A flow 373 may be communicated through the tubing passageway for purposes of displacing mud with cleaner gravel packing fluid. Thus, the cleaner gravel packing fluid is communicated through the central passageway of the screen assemblies 110 and returns via an annulus flow 375 to the surface of the well to displace the mud.

Figure 13:
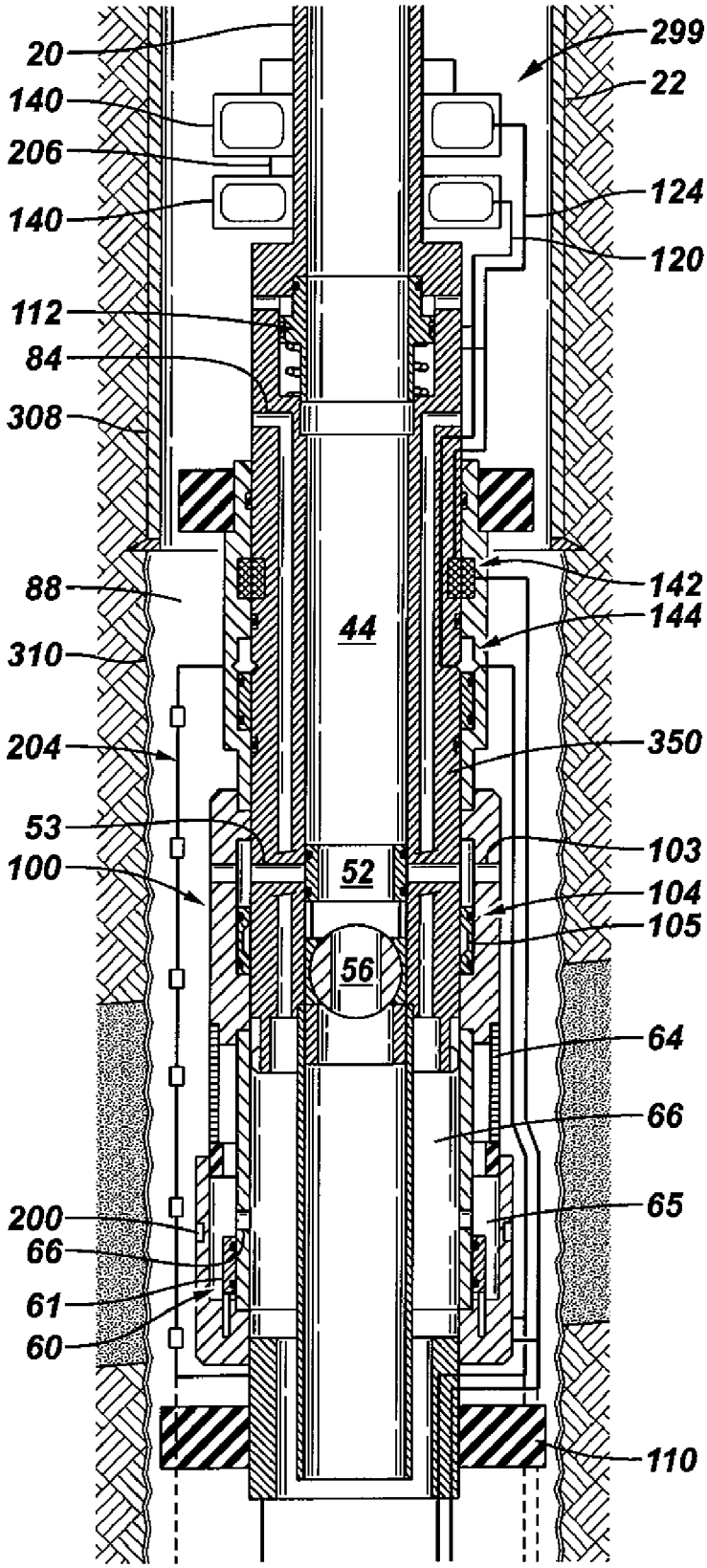
FIG. 13 is a schematic diagram of the completion assembly of FIG. 12 illustrating sensors and telemetry modules of the completion assembly according to an embodiment of the invention.

Referring to FIG. 13, the gravel packing service tool 350 and screen assembly may have various sensors and telemetry modules, similar to the sensors and telemetry modules described above.

Figure 14:
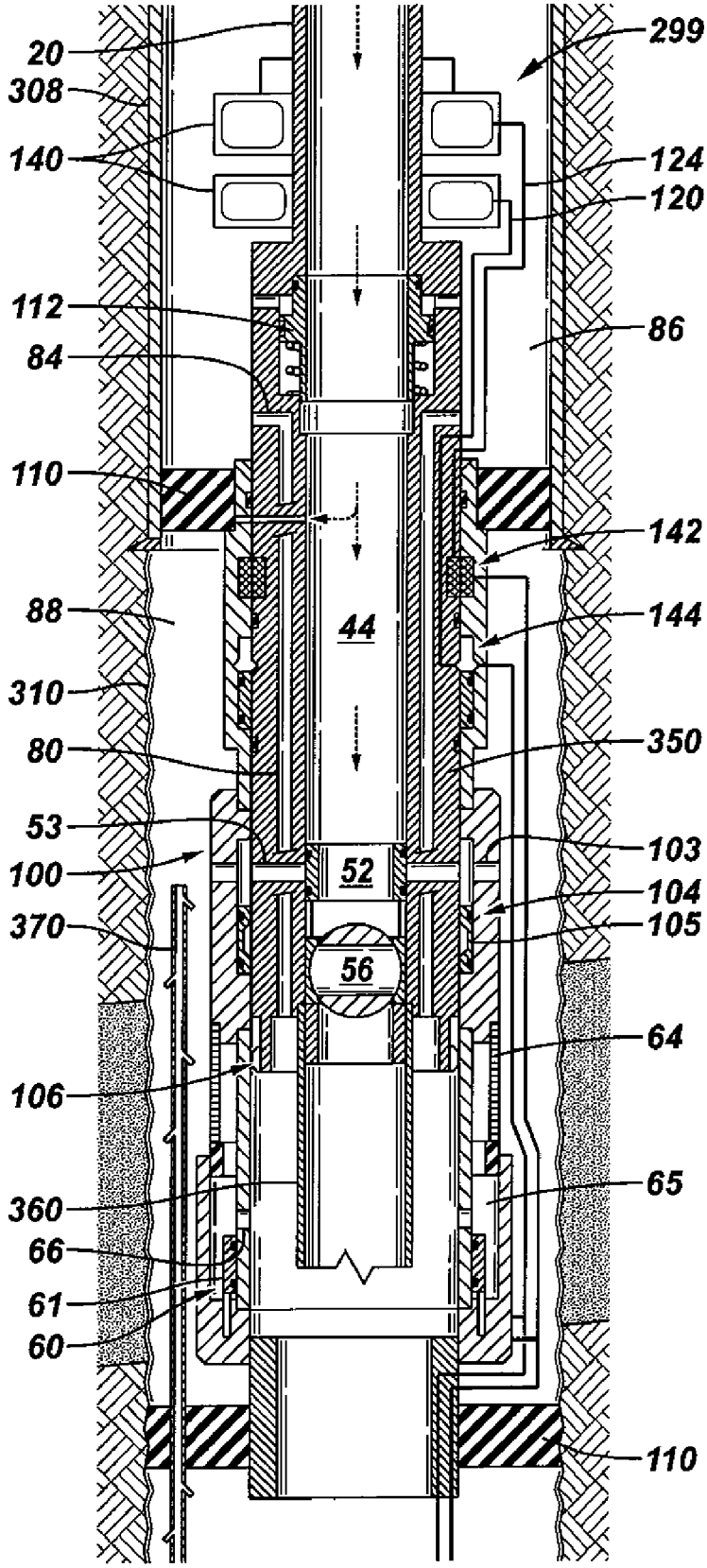
FIG. 14 is a schematic diagram of the completion assembly of FIG. 12 in a state to set and test a sand control packer of the completion assembly according to an embodiment of the invention.

Referring to FIG. 14, after the completion assembly 299, which may contain several connected screen assemblies 100, is stabbed into the sump packer (not shown), the packers 110 may then be set. More specifically, many techniques may be used to set the packers 110, such as closing the ball valve 56 and pressurizing the tubing annulus, as well as various other communication techniques.

Figure 15:
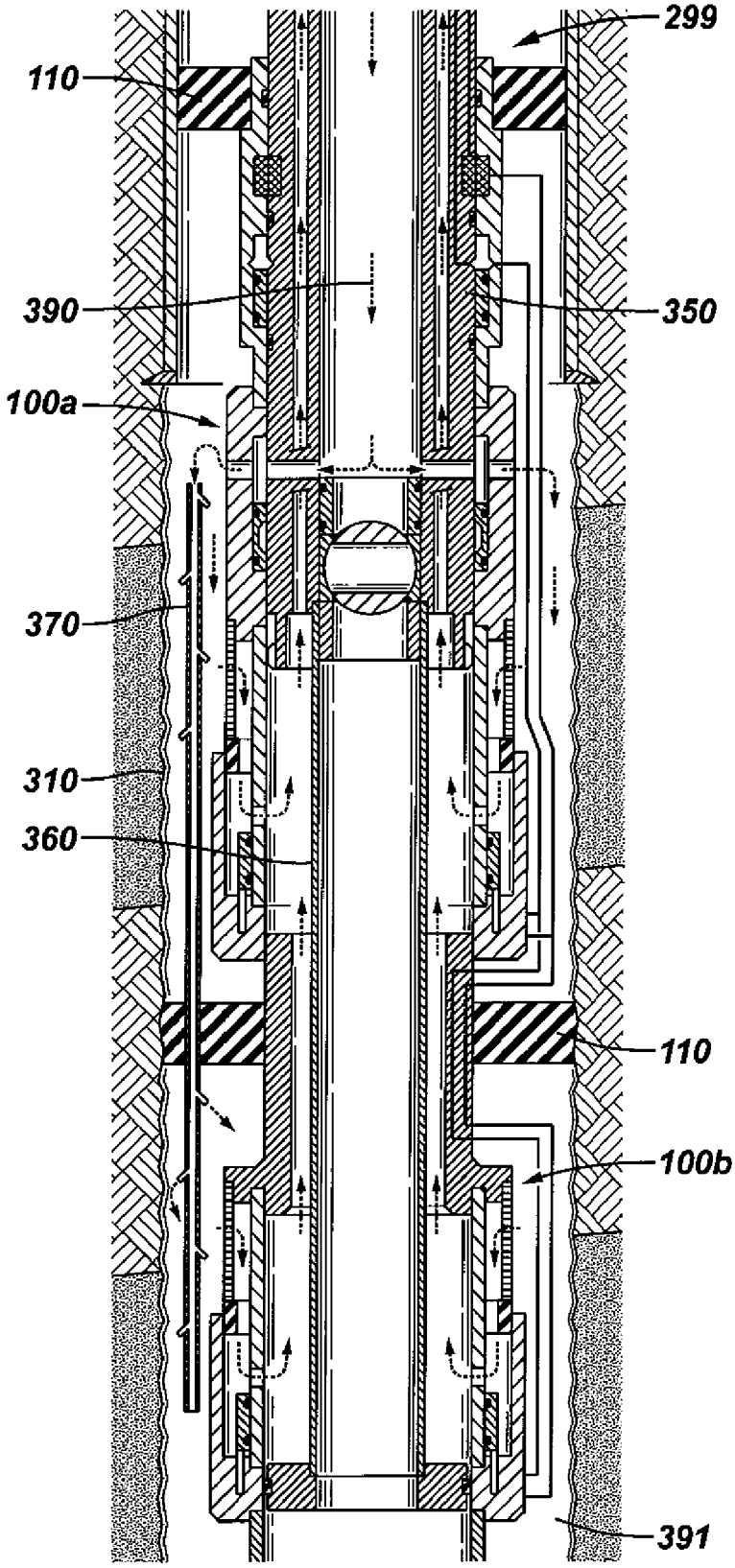
FIG. 15 is a schematic diagram of the completion assembly of FIG. 12 in a state to circulate a gravel slurry according to an embodiment of the invention.

Referring to FIG. 15, after the packers 110 are set, slurry may then be communicated downhole for purposes of depositing gravel sand in the various zones. FIG. 15 depicts two exemplary screen assemblies: a screen assembly 100*a*, of similar design to the screen assembly 100 that contains the service tool 350 and is the uppermost packer; and an adjacent screen assembly 100*b*. As discussed above, the sand control operation may involve simultaneously packing all of the zones at once.

To simultaneously gravel pack the zones, a command may be communicated from the surface to open the circulation valve 52 of the service tool 350; and then, due to the ball valve 56 being closed, a slurry flow 390 that is communicated through the central passageway of the tubing string flows through the circulation valves 52 and 104 into the annular region 86 of the uppermost zone. Due to the shunt tube 370, the slurry flow is also communicated into an isolated annular region 391 of the next zone. The slurry flow is communicated to the other zones in a similar manner through other shunt tubes. Gravel sand is thus deposited in these zones, and the slurry fluid returns via the flow control valves 60 along the outside of the wash pipe 370. The crossover ports 80 of the service tool 350 routes the returning slurry fluid into the annular region 86 above the packer 110 of the uppermost screen assembly 100*a*.

Figure 16:
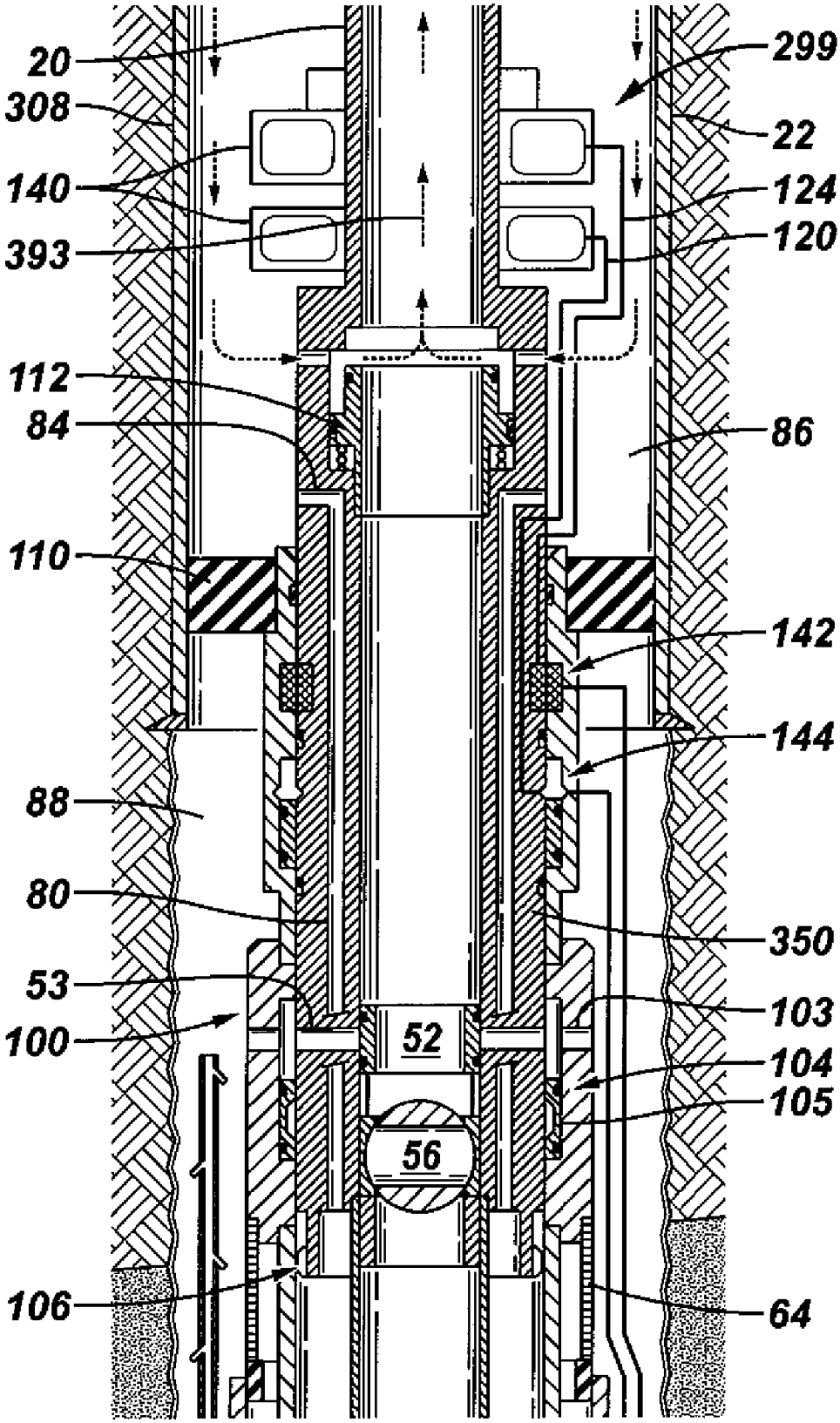
FIG. 16 is a schematic diagram of the completion assembly of FIG. 12 in a state to reverse circulate a gravel slurry from a tubing string according to an embodiment of the invention.

Referring to FIG. 16, after the sand control operation is complete, a command may then be communicated from the surface to close the circulation valve 56 of the service tool 350. Next, a command is communicated downhole to cause the modules 140 to close the flow control valves 60. The annular region 86 may then be pressurized to open the reversing check valve 112 to produce a reverse circulation flow 393 that is depicted in FIG. 16. As discussed above, reversing the valve may be located below the packer 110, may be controlled by the modules 140, may be a check valve, etc. After the gravel packing slurry in the string is displaced with clean fluid, the pumping is halted, and the reversing valve 112 is either closed automatically or in response to a command from the surface. Additionally, re-stressing may be employed, in which the reversing valve 112 is closed, the circulation valves 56 are opened, the flow control valves 56 are opened and the pack is re-stressed.

Figure 17:
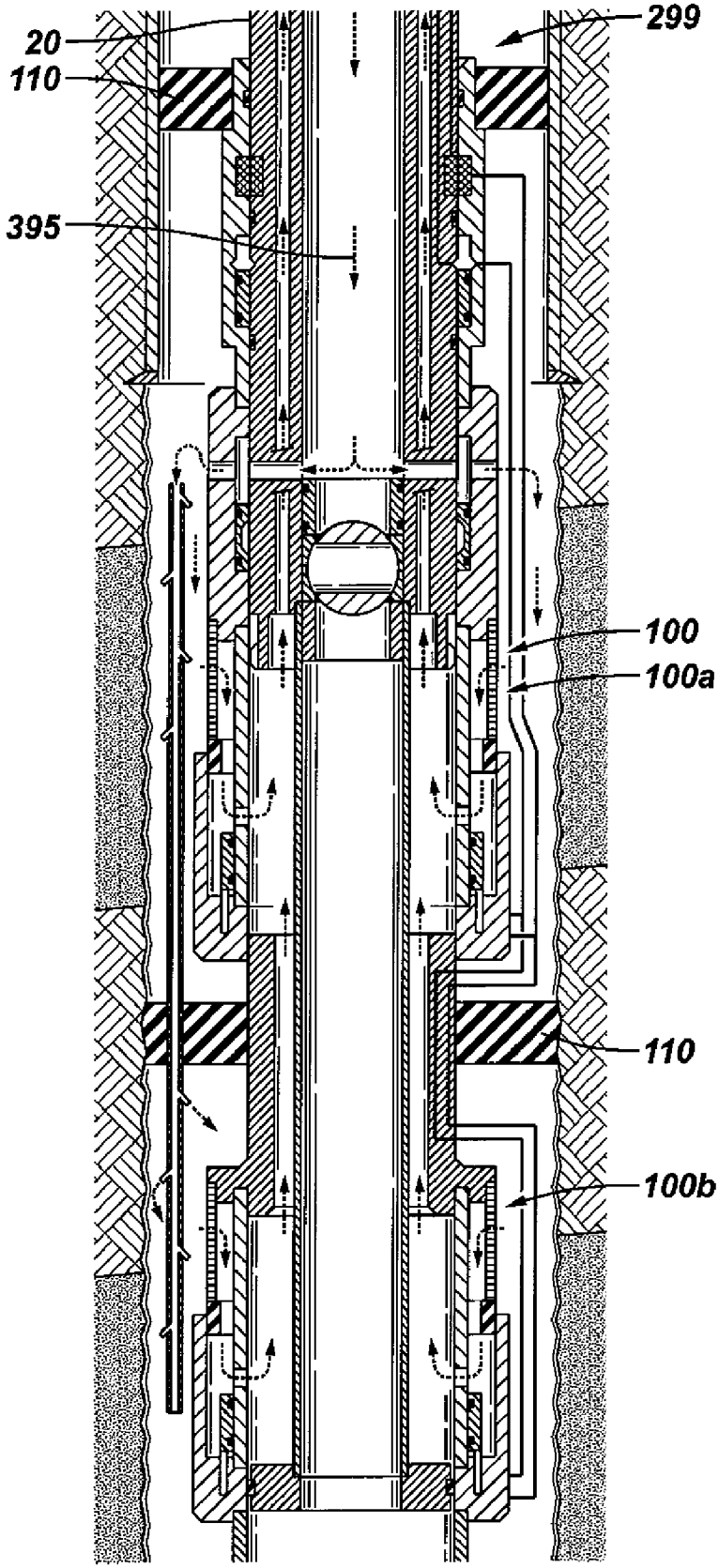
FIG. 17 is a schematic diagram of the completion assembly of FIG. 12 in a state to communicate a spot breaker according to an embodiment of the invention.
Figure 18:
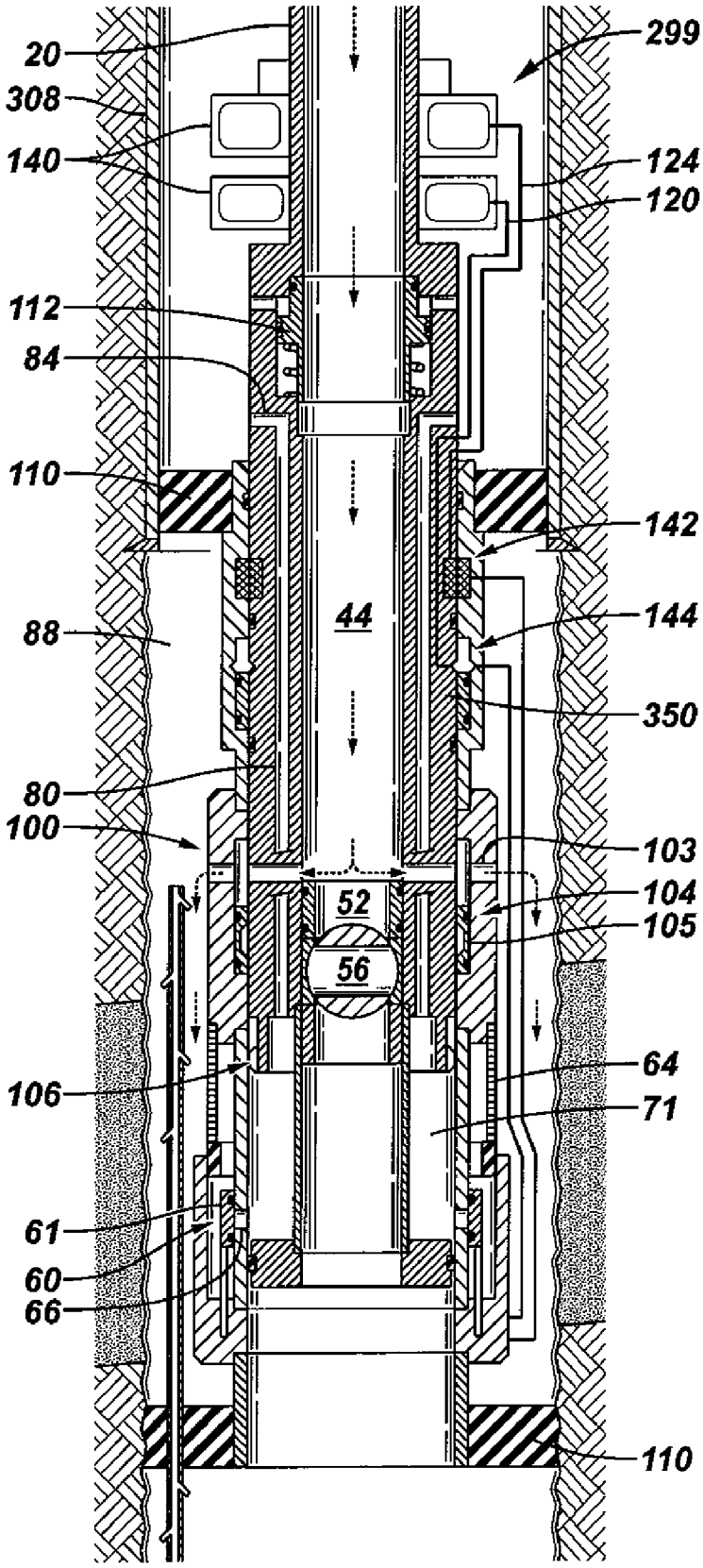
FIG. 18 is a schematic diagram of completion assembly of FIG. 12 in a state to stop the communication of the spot breaker according to an embodiment of the invention.

Referring to FIG. 17, a chemical called a "spot breaker" may then be introduced for purposes of removing mudcake. In this regard, the lower completion 299 is configured in the same manner as for the gravel packing operation. However, a spot breaker chemical 395 instead of gravel slurry is communicated into the zones, and the pumping is halted once the desired volume is spotted across the formation. As depicted in FIG. 18, the flow control valve ports 60 are closed to stop the spotting operation once the desired volume is achieved.

Figure 19:
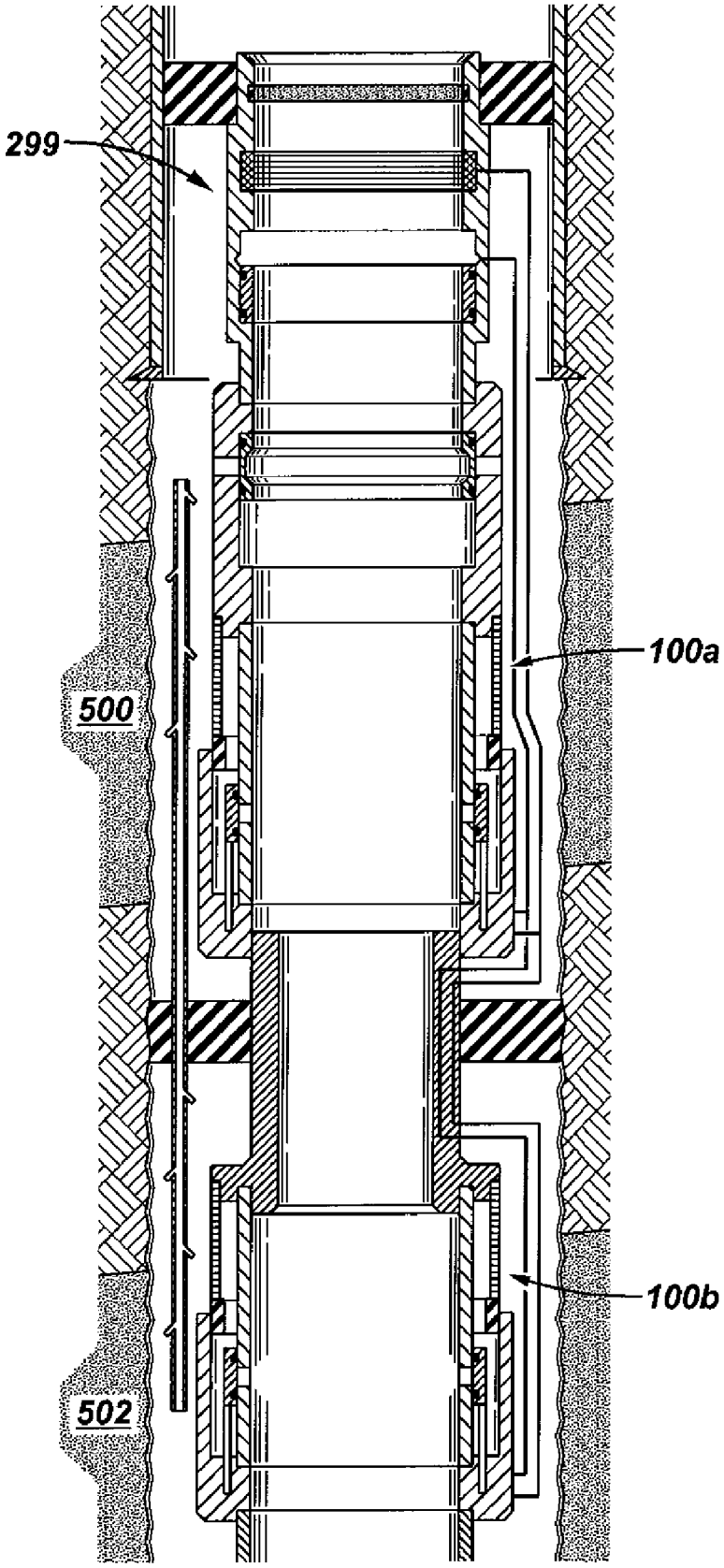
FIG. 19 is a schematic diagram of a screen assembly of the completion assembly of FIG. 12 after withdrawal of a service tool from the completion assembly according to an embodiment of the invention.

Referring to FIG. 19, in accordance with embodiment of the invention, the gravel packing service tool is unlatched from the upper screen assembly 100*a* and removed from the lower completion at the conclusion of the gravel packing and spotting operations. FIG. 19 depicts the exemplary screen assembly 100*a* being associated with an upper zone 500 and the screen assembly 100*b* being associated with a lower zone 502.

For purposes of withdrawing the gravel packing service tool 350 from the well, a command is communicated downhole to close the circulation valve 52. The tubing string is then pressurized to unlatch the service tool 350 from the corresponding packer latch in the upper screen assembly 100. Next, a command is communicated from the surface to open the ball valve 56, and then, the service tool 350 is retrieved to the surface by retrieving the string and service tool 350. When the service tool 350 is retrieved from the upper screen assembly, the PCS shifting tool 106 automatically closes the circulation port 104 of the screen assembly 100. Additionally, the hydraulic wet connection isolation sleeve 144 isolates the wet connect interface to prevent wellbore fluid from entering the hydraulic control line. The flow control valves 60 (now closed) provide fluid loss and well control.

Figure 20:
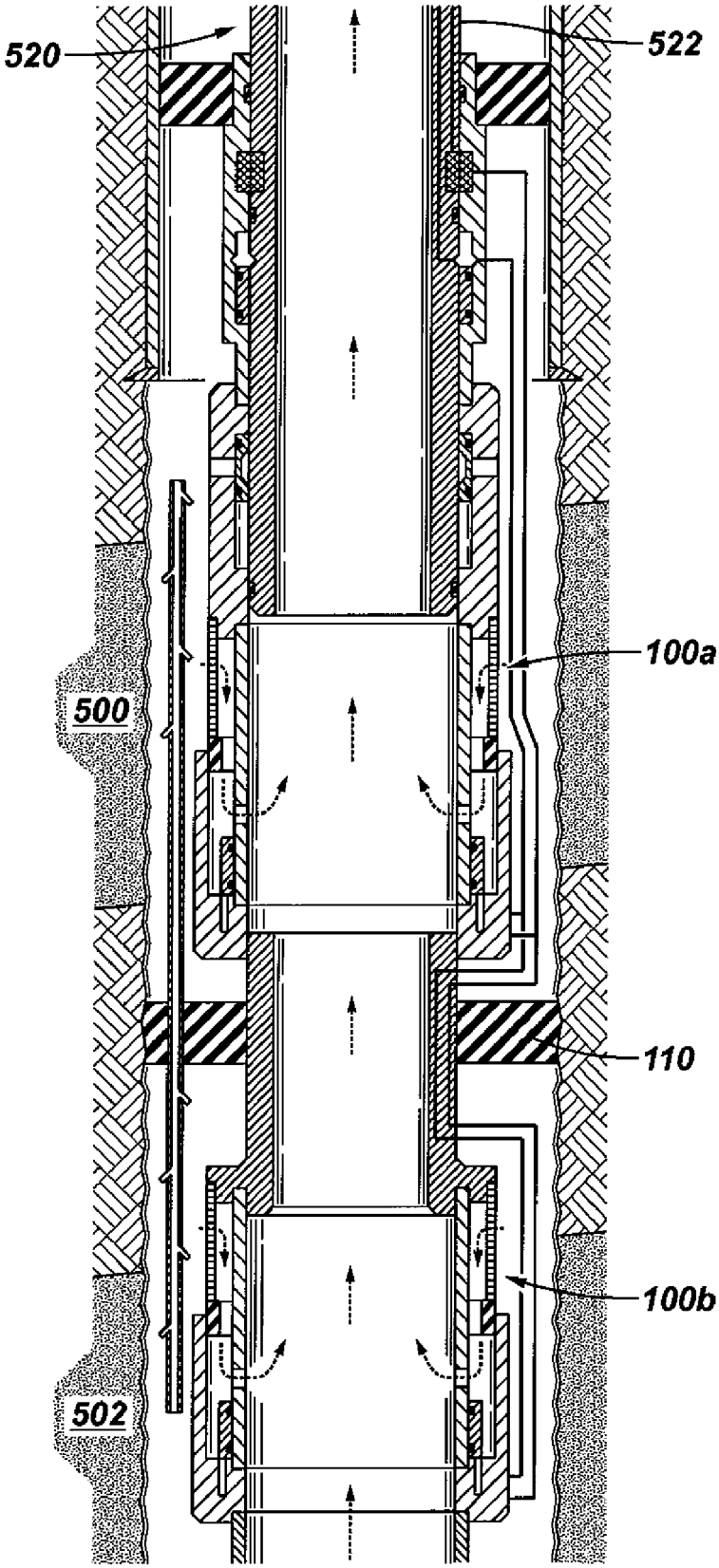
FIG. 20 is a schematic diagram of a multiple zone, open hole completion according to an embodiment of the invention.

Referring to FIG. 20, after the service tool 50 is removed from the well, an upper completion 520 is run into the uppermost screen assembly 100*a*. The upper completion 520 includes an extension 522 for purposes of forming electrical and hydraulic connections with the screen assemblies 100 of the lower completion. The upper completion 520 is connected to a production tubing string that extends to the surface of the well 10. As described above, wired or wireless stimuli may then be used for purposes of controlling the flow control valve 60 in the completion. Thus, to run the upper completion, the upper completion 520 is run into the hole and stabbed and located into the gravel packing packer 110 of the upper screen assembly 110*a* to establish electric wet connections between the upper zone and lower zone and isolate the gravel packing port closure sleeve. Electrical cables and hydraulic control lines may be run to the surface outside of the production tubing or inside the tubing walls for purposes of establishing communication with the surface, although telemetry and control techniques may be used in accordance with other embodiments of the invention.

Figure 21:
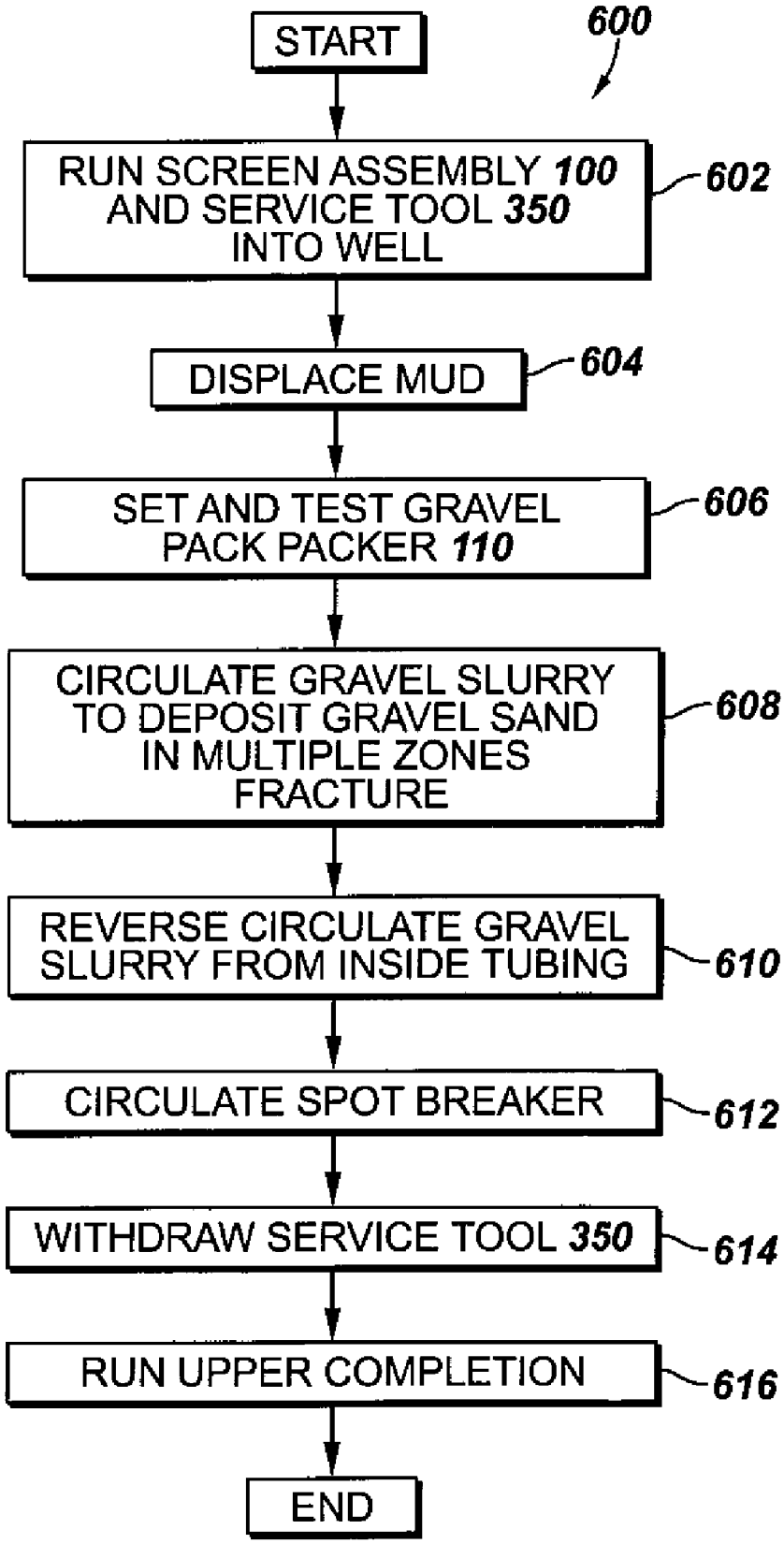
FIG. 21 is a flow diagram depicting an open hole well completion technique according to an embodiment of the invention.

Referring to FIG. 21, a technique 600 to complete multiple zones of an openhole wellbore, in accordance with embodiments of the invention, includes running screen assemblies and a service tool 350 into the well as a lower completion, pursuant to block 602. Fluid is then communicated through the lower completion to displace mud, pursuant to block 604, and gravel pack packers 110 of the screen assemblies are then set and tested, pursuant to block 606. A gravel slurry flow is then circulated through the lower completion to deposit gravel sand in multiple zones, pursuant to block 608; and subsequently, the gravel slurry that is present in the tubing string is reverse circulated (block 610) from inside the tubing to the surface of the well. Subsequently, a spot breaker is circulated, pursuant to block 612, into the zones. After communication of the spot breaker, the service tool 350 is then withdrawn from the well, pursuant to block 614 and the upper completion is then run into the well, pursuant to block 616.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A method usable with a well, comprising:

running a screen assembly and a service tool as a unit into the well;

using the service tool in connection with a sand control operation, comprising operating at least one valve of the screen assembly;

withdrawing the service tool from the well after the sand control operation; and running a completion into the well to operate at least one valve of the screen assembly after the withdrawal.

2. The method of claim 1, wherein the act of using the service tool comprises:

opening a flow control valve and gravel packing ports of the screen assembly to displace mud in the well with other fluid.

3. The method of claim 1, wherein the act of using the service tool comprises setting a packer of the screen assembly.

4. The method of claim 1, wherein the act of using the service tool comprises:

opening a flow control valve of the screen assembly and circulating ports of the service tool to circulate fluid to deposit a substrate outside of the screen assembly.

5. The method of claim 1, wherein the act of using the service tool comprises:

closing a flow control valve of the screen assembly and circulating ports of the service tool; and opening a reverse circulation port of the service tool to circulate gravel slurry out of a string connected to the service tool.

6. The method of claim 1, wherein the act of withdrawing comprises:

operating the service tool to close at least one valve of the screen assembly to isolate a zone of the well; and disconnecting the service tool from a lower completion.

7. The method of claim 1, wherein the screen assembly spans multiple zones of the well, the method further comprising:

using the service tool to simultaneously gravel pack or frac pack the zones.

8. The method of claim 7, wherein the act of using the service tool to simultaneously gravel pack the zones comprises:

establishing an isolated region for each zone; and communicating a gravel packing slurry through a shunt tube that extends into the isolated regions.

9. The method of claim 1, further comprising:

using the service tool to communicate a spotting breaker using at least one valve of the screen assembly.

10. The method of claim 1, wherein the act of using occurs in an uncased wellbore or a cased wellbore.

* * * * *